US008382089B2

(12) United States Patent
Yonekawa et al.

(10) Patent No.: US 8,382,089 B2
(45) Date of Patent: Feb. 26, 2013

(54) SHEET CUTTING APPARATUS AND SHEET POST-PROCESSING APPARATUS HAVING THE SAME, AND IMAGE FORMING SYSTEM

(75) Inventors: Ken Yonekawa, Moriya (JP); Kenji Toppada, Noda (JP); Keiichi Mizukami, Tokyo (JP)

(73) Assignee: Canon Finetech Inc., Misato-shi (JP)

( * ) Notice: Subject to any disclaimer, the term of this patent is extended or adjusted under 35 U.S.C. 154(b) by 222 days.

(21) Appl. No.: 12/755,834

(22) Filed: Apr. 7, 2010

(65) Prior Publication Data

US 2010/0254782 A1 Oct. 7, 2010

(30) Foreign Application Priority Data

Apr. 7, 2009 (JP) ..... 2009-092730
Apr. 5, 2010 (JP) ..... 2010-086730

(51) Int. Cl.
*B65H 37/04* (2006.01)

(52) U.S. Cl. ..... 270/21.1; 270/37; 270/45; 270/52.17; 270/58.07; 270/58.08; 270/58.12; 270/58.17

(58) Field of Classification Search ..... 270/21.1, 270/37, 45, 52.17, 58.07, 58.08, 58.12, 58.17; 83/419
See application file for complete search history.

(56) References Cited

U.S. PATENT DOCUMENTS 5,365,817 A 11/1994 Maeda et al.
5,377,965 A * 1/1995 Mandel et al. ..... 270/37
6,575,447 B2 * 6/2003 Yoshie et al. ..... 270/58.07

FOREIGN PATENT DOCUMENTS

JP 5-169396 7/1993
JP 2005-263404 A 9/2005
JP 2006-082153 3/2006
JP 2008-068352 A 3/2008

OTHER PUBLICATIONS

Office Action dated Oct. 9, 2012, in Japanese Patent Application No. 2010-086730.
Office Action, dated Jan. 8, 2013, in Japanese Patent Application No. 2010-086730.

* cited by examiner

*Primary Examiner* — Leslie A Nicholson, III
(74) *Attorney, Agent, or Firm* — Fitzpatrick, Cella, Harper & Scinto

(57) ABSTRACT

A sheet cutting apparatus, including: a conveying member configured to convey a half-folded sheet bunch in a conveyance path in which the conveying member is provided; a registration member which comes into contact with a leading edge portion of the sheet bunch to correct a skew feed of the sheet bunch; a cutting member positioned upstream of the registration member to cut a trailing edge portion of the sheet bunch; and a discharging member provided at an outlet of the conveyance path to discharge the sheet bunch, wherein the leading edge portion of the sheet bunch is positioned outside the discharging member when, after the skew feed is corrected, the sheet bunch is conveyed downstream in the conveying direction by the conveying member and the trailing edge portion of the sheet bunch is conveyed to a cutting position of the cutting member to cut the trailing edge portion.

11 Claims, 15 Drawing Sheets

SHEET CUTTING APPARATUS AND SHEET POST-PROCESSING APPARATUS HAVING THE SAME, AND IMAGE FORMING SYSTEM

BACKGROUND OF THE INVENTION

1. Field of the Invention

The present invention relates to a sheet cutting apparatus adapted to cut edge portions of a half-folded sheet bunch which is folded in a shape of a brochure so that the edge portions are aligned, and to a sheet post-processing apparatus having the sheet cutting apparatus, and an image forming system.

2. Description of the Related Art

In image forming apparatuses, such as a copier, a printing apparatus, or a facsimile machine and image forming systems such as a bookbinding machine, various kinds of sheet processing have been realized in recent years. In post-processings, such as saddle stitching bookbinding or case binding, edge portions of a half-folded sheet bunch which is folded in the shape of a brochure using a folding processing mechanism (center-folding unit) are cut by a sheet cutting apparatus (trimmer unit) so that the edge portions are aligned. For example, as illustrated in FIG. 12, a half-folded sheet bunch 301 which is folded about a half-folded portion (left edge portion of FIG. 12) in the shape of a brochure has edge portions (fore edge which is a right edge portion of FIG. 12) 301*a* which form a v-shaped overhanging curved surface. When a user turns a page with his/her finger, the turning of pages is stopped at the center page so that it may be difficult to turn a page when the page is in the latter half of the brochure. Therefore, conventionally, a cutting member provided in the sheet cutting apparatus is used to cut the edge portions (fore edge) 301*a* of a spread of the half-folded sheet bunch 301 described above so that the edge portions are substantially aligned and form a flat surface to perform satisfactory bookbinding (Japanese Patent Application Laid-Open No. 2006-82153 and Japanese Patent Application Laid-Open No. H05-169396).

When such a sheet cutting apparatus (trimmer unit) is used to cut the half-folded sheet bunch 301, first, skew feed correction of the half-folded sheet bunch 301, which is folded about the half-folded portion in the shape of a brochure, is made by an appropriate registration member. After that, the sheet bunch 301 is conveyed to a predetermined position and the relative position thereof with respect to a cutting blade is adjusted. After that, the cutting blade shears the half-folded sheet bunch 301 having an appropriate set cutting margin so that the edge portions (fore edge) 301*a* of the spread of the half-folded sheet bunch 301 are cut.

However, the entire size of a conventional sheet cutting apparatus (trimmer unit) is very large in order that the sheet cutting apparatus have various functions, and hence, in some cases, such a sheet cutting apparatus cannot be placed in limited spaces, such as an office. Thus, under the present circumstances, such a sheet cutting apparatus is not popularly used. A main reason of such an increase in size of a sheet cutting apparatus is that, in particular, a distance for storing the half-folded sheet bunch is necessary between the cutting blade as the cutting member and the above-mentioned registration member. More specifically, the distance between the cutting blade and the registration member for storing the sheet bunch needs to be set longer than at least the maximum size of the half-folded sheet bunch, which makes large the length of the apparatus as a whole in a conveying direction of the half-folded sheet bunch and, eventually, makes large the apparatus as a whole.

Immediately before such a half-folded sheet bunch is cut, in the sheet cutting apparatus, for example, an appropriate plate-like pressing member presses flatly the whole half-folded sheet bunch so that air is removed from the inside of the half-folded sheet bunch. However, in a conventional sheet cutting apparatus, in order to press flatly the whole half-folded sheet bunch, the pressing member is formed of a large plate-like member, which is another reason that the apparatus itself is increased in size.

For example, in an image forming system in which a sheet post-processing apparatus B2 is attached to an image forming apparatus A2 as illustrated in FIG. 13, a trimmer unit C2 is disposed so as to protrude from a lower end portion of the sheet post-processing apparatus B2 toward a downstream side. However, if such a large trimmer unit C2 is attached, not only the footprint of the image forming system as a whole becomes extremely large but also there are other problems including reduced amount of sheets which can be stacked on a sheet stacking tray 303 provided to the sheet post-processing apparatus B2 because the movable range in a vertical direction of the sheet stacking tray 303 becomes small.

SUMMARY OF THE INVENTION

Accordingly, an object of the present invention is to provide a sheet cutting apparatus which is miniaturized with a simple structure, and a sheet post-processing apparatus having the sheet cutting apparatus, and an image forming system.

In order to achieve the above-mentioned object, a sheet cutting apparatus according to the present invention includes: a conveying member configured to convey a half-folded sheet bunch, the conveying member being provided in a conveyance path through which the half-folded sheet bunch is conveyed; a registration member which comes into contact with a leading edge portion of the conveyed half-folded sheet bunch to correct a skew feed of the half-folded sheet bunch; a cutting member configured to cut a trailing edge portion of the half-folded sheet bunch in a conveying direction of the half-folded sheet bunch, the cutting member being positioned upstream of the registration member in the conveying direction of the half-folded sheet bunch; and a discharging member configured to discharge the half-folded sheet bunch, the discharging member being provided at an outlet of the conveyance path, wherein the leading edge portion of the half-folded sheet bunch is positioned outside the discharging member when, after the skew feed is corrected by the registration member, the half-folded sheet bunch is conveyed downstream in the conveying direction of the half-folded sheet bunch by the conveying member and the trailing edge portion of the half-folded sheet bunch is conveyed to a cutting position of the cutting member to perform the cutting.

According to the present invention structured as described above, even in a case that a distance between the registration member and the cutting member is small, the half-folded sheet bunch is conveyed after skew feed correction is performed by the registration member so that a part of the half-folded sheet bunch can be protruded outside the apparatus, and the cutting can be performed with the part protruding outside the apparatus. Therefore, the distance between the registration member and the cutting member can be set shorter than a size of the half-folded sheet bunch, and a length of the sheet cutting apparatus as a whole in a conveying direction of the half-folded sheet bunch is drastically decreased correspondingly.

Further, the registration member according to the present invention may be adapted to correct a skew feed when the registration member moves from a standby position.

According to the present invention structured as described above, even when the distance between the registration member and the cutting member is drastically decreased, by moving the registration member according to the size of the half-folded sheet bunch, skew feed correction and cutting can be performed with respect to a half-folded sheet bunch of a large size.

Further, the standby position of the registration member according to the present invention may be set to be a position outside the sheet cutting apparatus.

According to the present invention structured as described above, even if the length of the sheet cutting apparatus as a whole is drastically decreased, when the half-folded sheet bunch is large-sized and long, the registration member can be positioned outside the sheet cutting apparatus and accordingly, even in such a case, the skew feed correction function of the registration member is not impaired.

As described above, according to the present invention, a half-folded sheet bunch of which a skew feed is corrected by the registration member is conveyed by the conveying member so that a half-folded portion protrudes outside the discharging member provided at the outlet of the conveyance path, and edge portions of the half-folded sheet bunch are cut by the cutting member. Even when the distance between the registration member and the cutting member is small, by protruding the half-folded sheet bunch outside the sheet cutting apparatus, skew feed correction and cutting thereof can be performed. The distance between the registration member and the cutting member is set to be smaller than the size of the half-folded sheet bunch so that the length of the sheet cutting apparatus as a whole in the conveying direction of the half-folded sheet bunch is drastically decreased. Therefore, the sheet cutting apparatus as a whole can be reduced in size with a simple and low-cost structure, and can be placed in an ordinary office or the like while materializing a high-quality sheet processing function with ease.

Further features of the present invention will become apparent from the following description of exemplary embodiments with reference to the attached drawings.

BRIEF DESCRIPTION OF THE DRAWINGS

FIGS. 3A and 3B illustrate a structure of a saddle stitching staple unit of the sheet post-processing apparatus illustrated in FIG. 2, in which FIG. 3A is an explanatory side view illustrating a whole structure thereof, and FIG. 3B is an explanatory front view illustrating an anvil portion.

FIGS. 4A, 4B, 4C and 4D are explanatory side views of a folding roller mechanism of the sheet post-processing apparatus illustrated in FIG. 2, in which FIG. 4A illustrates a state in which a sheet bunch is collected, FIG. 4B illustrates a state in which the sheet bunch is inserted by a folding blade into a nip formed by folding rollers, FIG. 4C illustrates an initial state in which the sheet bunch is started to be folded by the folding rollers, and FIG. 4D illustrates a state in which the sheet bunch is being folded by the folding rollers.

FIGS. 6A, 6B, 6C and 6D are explanatory enlarged side views illustrating positioning in the trimmer unit (sheet cutting apparatus) illustrated in FIG. 5, in which FIG. 6A illustrates a state in which a half-folded sheet bunch is conveyed, FIG. 6B illustrates a skew feed correction operation with respect to the half-folded sheet bunch, FIG. 6C illustrates a state in which the half-folded sheet bunch is pressed, and FIG. 6D illustrates a state in which the half-folded sheet bunch is, after being pressed, conveyed and air is removed therefrom.

FIGS. 8A and 8B are explanatory partial enlarged side views illustrating a state in which the half-folded sheet bunch is cut by the trimmer unit (sheet cutting apparatus) and scraps are discharged, in which FIG. 8A illustrates a state in which the half-folded sheet bunch is conveyed to a cutting position, and FIG. 8B illustrates a state immediately after the cutting.

FIGS. 9A through 9D illustrate a conveyance operation when the half-folded sheet bunch is cut in the trimmer unit (sheet cutting apparatus), in which FIG. 9A illustrates a state in which a half-folded sheet bunch of a maximum size is conveyed, FIG. 9B illustrates a skew feed correction operation with respect to the half-folded sheet bunch of the maximum size, FIG. 9C illustrates a state in which the half-folded sheet bunch is pressed, conveyed and air is removed therefrom; and FIG. 9D illustrates a state in which the half-folded sheet bunch is to be discharged.

DESCRIPTION OF THE EMBODIMENT

Figure 1:
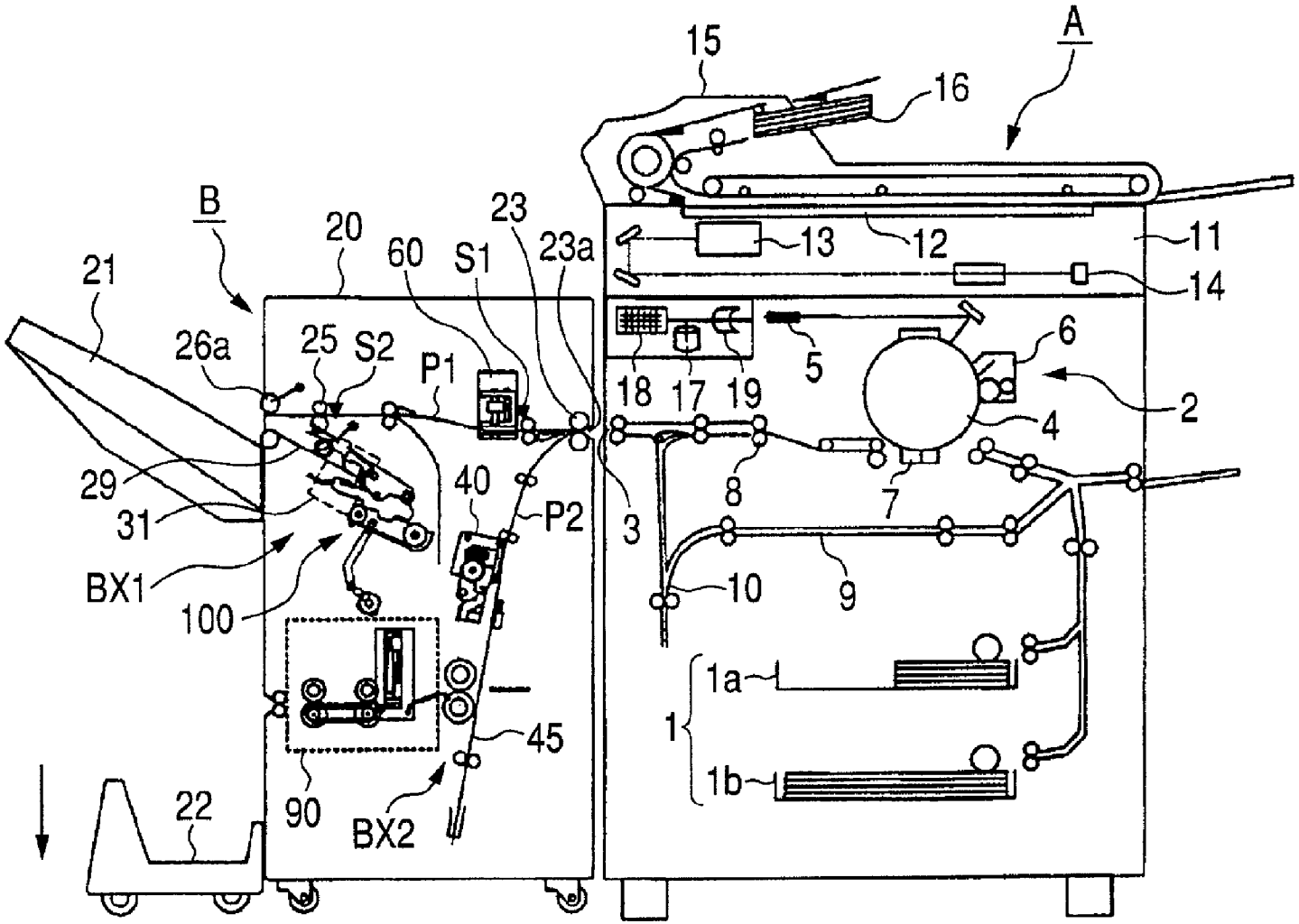
FIG. 1 is an explanatory side view illustrating a whole structure of an exemplary image forming system to which the present invention is applied.

Referring to the drawings, an embodiment is described below in detail, in which the present invention is applied to an image forming system including a sheet post-processing apparatus B in a copier A as an image forming apparatus.

[Configuration of the Image Forming System]

The image forming system illustrated in FIG. 1 is a system in which the sheet post-processing apparatus B is provided continuously with the image forming apparatus A that forms images on sheet-shaped recording media, such as cut paper. In the image forming system, an inlet port 23*a* of the sheet post-processing apparatus B is coupled with a sheet discharge outlet 3 of the image forming apparatus A. Further, the image forming system has a configuration in which the sheet-shaped recording media having the images formed thereon by the image forming apparatus A are stitched with staples by the sheet post-processing apparatus B, and are stored in a stack tray 21 or a saddle tray 22.

[Configuration of the Image Forming Apparatus]

As illustrated in FIG. 1, the image forming apparatus A in the image forming system as described above is adapted so as to feed the sheet-shaped recording media, such as the cut paper from a sheet feeding portion 1 to an image forming portion 2, and to discharge the sheet-shaped recording media from the sheet discharge outlet 3 after performing printing for the sheet-shaped recording media in the image forming portion 2. The sheet feeding portion 1 includes sheet feeding cassettes 1*a* and 1*b* in which multiple sizes of the sheet-shaped recording media are stored. The sheet feeding portion 1 separates the designated sheet-shaped recording media one by one, and feeds the sheet-shaped recording media to the image forming portion 2. For example, the image forming portion 2 includes an electrostatic drum 4, and a laser emitting unit 5, a developing device 6, a transfer charger 7, and a fixing device 8, which are arranged on the periphery of the electrostatic drum 4. The image forming portion 2 forms each electrostatic latent image on the electrostatic drum 4 by the laser emitting unit 5, adheres toner onto the electrostatic latent image by the developing device 6, transfers each image to the sheet-shaped recording medium by the transfer charger 7, and heats and fixes the image by the fixing device 8. The sheet-shaped recording media on which the images are formed as described above are sequentially carried out from the sheet discharge outlet 3 to the sheet post-processing apparatus B. A circulating path 9 of FIG. 1 is a path for two-side printing of reversing sides of each sheet-shaped recording medium in which the image is printed on a front side, thereafter feeding the sheet-shaped recording medium to the image forming portion 2 one more time, and printing the image on a back side of the sheet-shaped recording medium. Here, each sheet-shaped recording medium is fed to the circulating path 9 from the fixing device 8 through a switch-back path 10. The sheet-shaped recording media subjected to such two-side printing are discharged from the sheet discharge outlet 3 after the sides thereof are reversed in the switch-back path 10.

Further, in FIG. 1, an image reading apparatus 11 scans an original sheet set on a platen 12 with a scan unit 13, and electrically reads the original sheet with a photoelectric conversion element 14. The image data is subjected to, for example, digital processing in an image processing portion, and then transferred to a data storing portion 17, and an image signal corresponding to the image data is sent to the laser emitting unit 5. Further, in FIG. 1, an original feeding apparatus 15 is a feeder apparatus for feeding an original sheet stored in a stack tray 16 to the platen 12.

Figure 11:
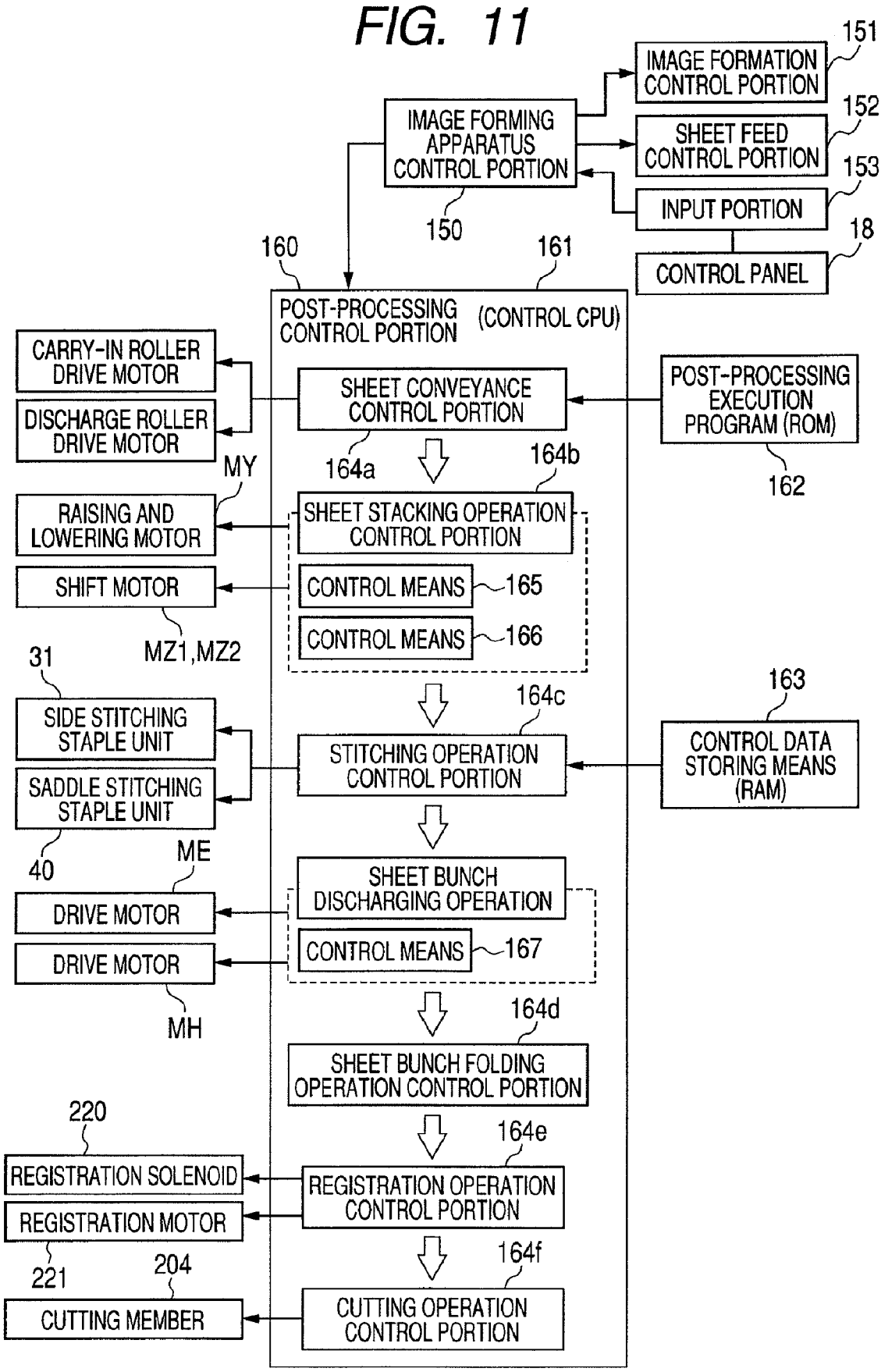
FIG. 11 is a block diagram illustrating a control structure of the image forming system illustrated in FIG. 1.
Figure 12:
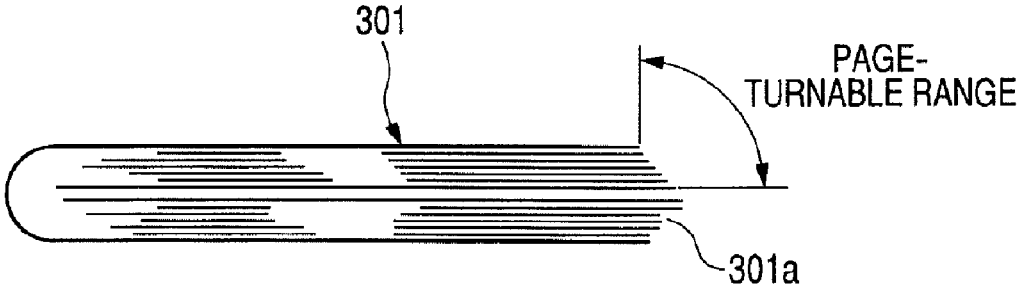
FIG. 12 is an explanatory side view illustrating the half-folded sheet bunch immediately after saddle stitching bookbinding.
Figure 13:
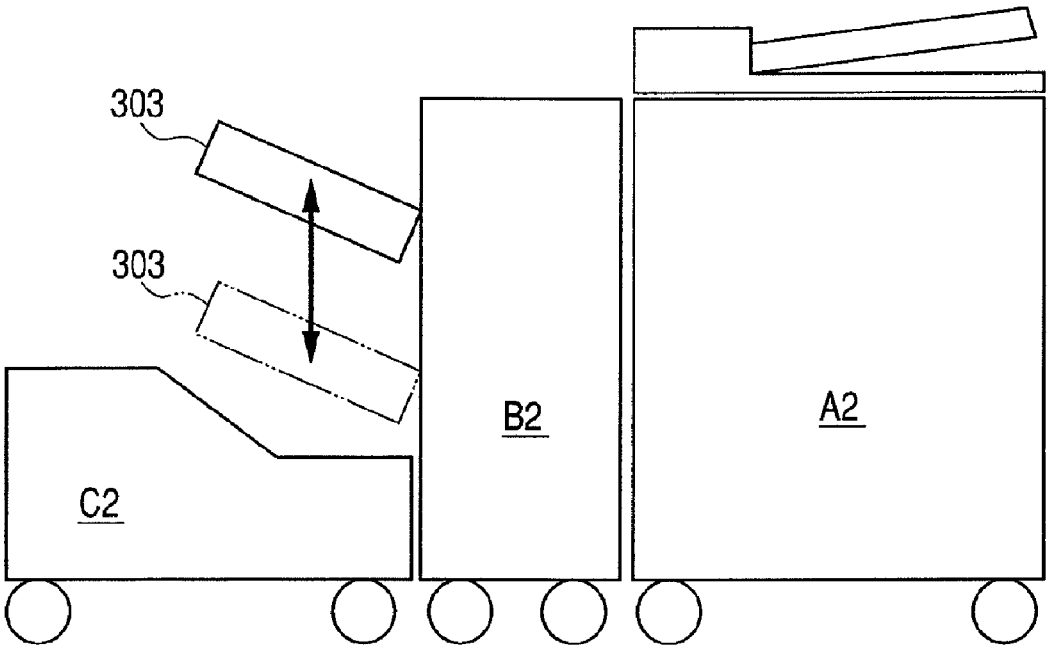
FIG. 13 is an explanatory side view illustrating an exemplary conventional image forming system.

The image forming apparatus A with the above-mentioned configuration is provided with an image forming apparatus control portion (controller) 150 as illustrated in FIG. 11, and, from a control panel 18, there are set image formation conditions including printing conditions, such as sheet size designation, number-of-printed sheet designation, one-side/two-side printing designation, and enlargement/reduction printing designation. Meanwhile, the image forming apparatus A is adapted so that image data read by the scan unit 13 or image data transferred from an external network is stored in the data storing portion 17, the image data is transferred to a buffer memory 19 from the data storing portion 17, and a data signal is sequentially output to the laser emitting unit 5 from the buffer memory 19.

A post-processing condition is also input and designated from the control panel 18, concurrently with the image formation conditions, such as one-side/two-side printing, enlargement/reduction printing, and monochrome/color printing. Selected as the post-processing condition in this case is, for example, a "print-out mode", "stitching finish mode", or "brochure finish mode".

[Configuration of the Sheet Post-Processing Apparatus]

The sheet post-processing apparatus B is adapted as described below to receive a sheet-shaped recording medium with the image formed thereon from the sheet discharge outlet 3 of the image forming apparatus A, and to (i) stack the sheet-shaped recording medium on the stack tray 21 without post-processing (print-out mode), (ii) collate sheet-shaped recording media from the sheet discharge outlet 3 in a bunch form to be stapled, and stack them on the stack tray (first stack tray) 21 (stitching finish mode), or (iii) collate sheet-shaped recording media from the sheet discharge outlet 3 in a bunch form, staple the center of the sheet-shaped recording media, and fold them in a brochure form to be stacked on the saddle tray (second stack tray) 22 (brochure finish mode).

Figure 2:
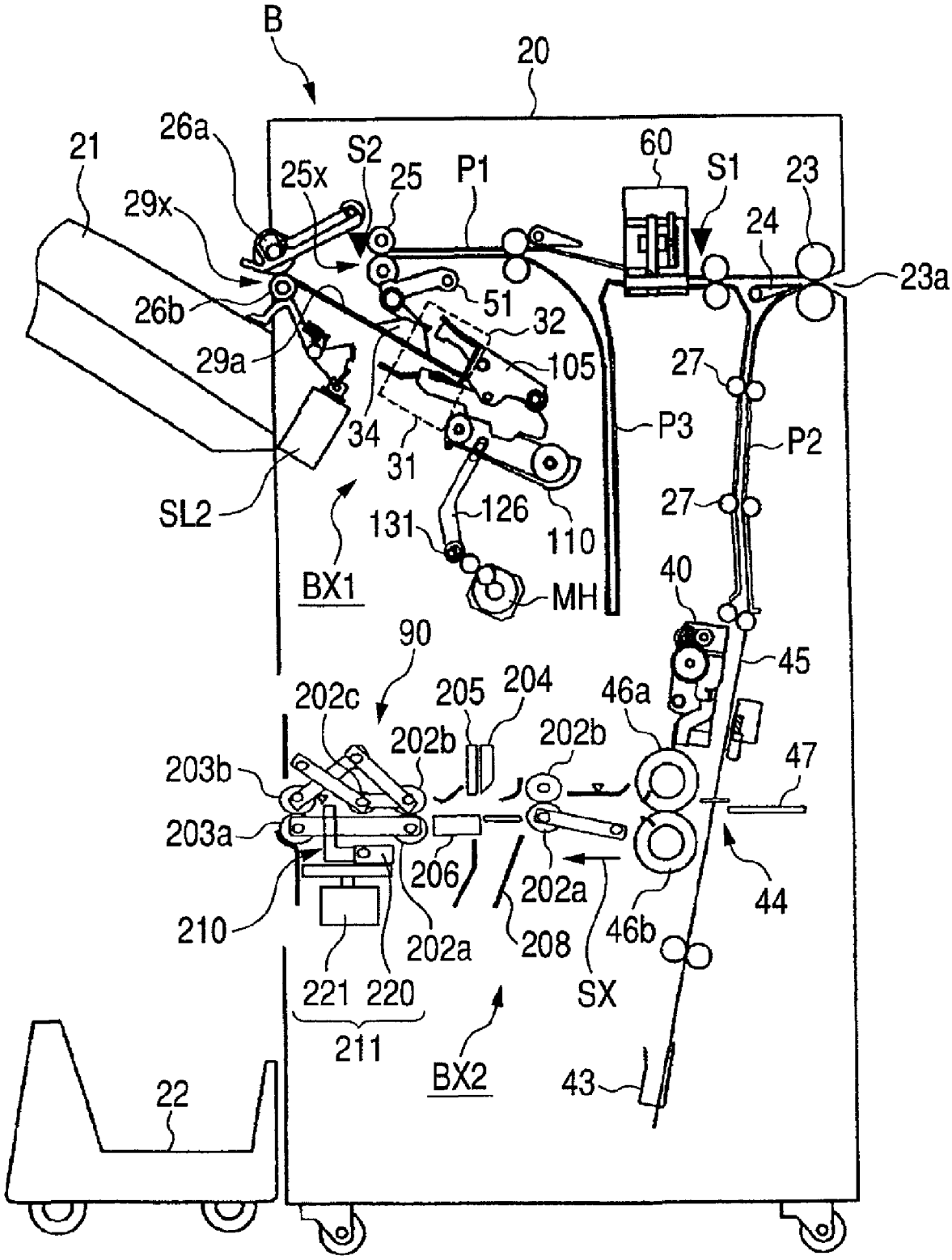
FIG. 2 is an explanatory enlarged side view illustrating a whole structure of a sheet post-processing apparatus (sheet handling apparatus) of the image forming system illustrated in FIG. 1

Specifically, as illustrated in FIG. 2 in particular, the inlet port 23*a* is provided on a casing (apparatus frame) 20 of the sheet post-processing apparatus B, and the inlet port 23*a* is coupled with the sheet discharge outlet 3 of the image forming apparatus A. The casing 20 includes therein a first processing portion BX1 that stacks and collates, for each set, the sheet-shaped recording media coming from the inlet port 23*a*, and performs a stitching finish, and a second processing portion BX2 that stacks and collates, for each set, the sheet-shaped recording media coming from the inlet port 23*a*, and performs a brochure finish. A first conveyance path P1 is provided between the first processing portion BX1 and the inlet port 23*a*, and a second conveyance path P2 is provided between the second processing portion BX2 and the inlet port 23*a*. In such a way, the sheet-shaped recording media coming from the inlet port 23*a* are distributed and guided to the first processing portion BX1 and the second processing portion BX2. In the vicinity of the inlet port 23*a*, there are provided carry-in rollers 23, a sheet sensor S1, and path switching means (flapper member) 24 that distributes the sheet-shaped recording media to the first and second conveyance paths P1 and P2.

The first conveyance path P1 includes a "buffer path P3" between a punch unit 60 and a process tray 29. When the post-processings, such as the staple stitching are performed for a bunch of the stacked sheet-shaped recording media (hereinafter, referred to as a sheet bunch) stacked and collated for each set on the process tray 29, the buffer path P3 temporarily stays therein a subsequent sheet-shaped recording medium delivered to the sheet inlet port 23*a* during such operation of the post-processing. Therefore, as illustrated in FIG. 2, the buffer path P3 is disposed to branch off from the first conveyance path P1 in the vertical direction of the casing 20 on the upstream side in the path reaching the process tray 29. Then, the sheet-shaped recording medium from the first conveyance path P1 is switched back and stays in this path. Accordingly, when the post-processing (side stitching processing described later) is performed on a bunch of sheets stacked and collated for each set on the process tray 29, a subsequent sheet-shaped recording medium sent to the inlet port temporary stays, and the subsequent sheet-shaped recording medium in this path can be conveyed to the process tray 29 after the preceding sheets processed on the process tray 29 are discharged.

The first conveyance path P1 is arranged in a substantially horizontal direction in an upper portion of an apparatus housing constructed by the casing 20. The first processing portion BX1 is arranged downstream of the first conveyance path P1, and the stack tray 21 is arranged downstream of the first processing portion BX1. In the first conveyance path P1, the punch unit 60 to be described later is arranged between the inlet port 23*a* and the first processing portion BX1. In the first conveyance path P1, sheet discharge rollers 25 and a sheet discharge outlet 25*x* are provided at an outlet end of the first conveyance path P1. A sheet discharge sensor S2 is arranged on the sheet discharge outlet 25*x*. The sheet discharge sensor S2 is adapted to detect the sheet-shaped recording media passing through the first conveyance path P1, and to detect a jam and count the number of sheets passing therethrough. A difference in level (a step) is formed downstream of the sheet discharge outlet 25*x*, and the process tray 29 to be described below is arranged there.

The second conveyance path P2 is arranged in a substantially vertical direction in a lower portion of the casing 20. The second processing portion BX2 is arranged downstream of the second conveyance path P2, and the saddle tray 22 is arranged downstream of the second processing portion BX2. Further, in the second conveyance path P2, a trimmer unit (cutting unit) 90 to be described later is arranged between the second processing portion BX2 and the saddle tray 22. Still further, in the second conveyance path P2, conveyance rollers 27 are provided. A difference in level (a step) is formed downstream of the conveyance rollers 27, and a stacking guide 45 to be described later is arranged there.

[Configuration of the First Processing Portion]

The first processing portion BX1 is formed of the process tray 29 disposed in the first conveyance path P1, a side stitching unit 31 disposed in the process tray 29, and aligning means 51. The processing tray 29 is formed of a synthetic resin plate or the like, and is provided with a sheet support surface 29*a* to support sheet-shaped recording media stacked thereon. The support surface 29*a* is disposed to form a difference in level (a step) downstream of the sheet discharge outlet 25*x* of the first conveyance path P1, and stores and stacks sheet-shaped recording media from the sheet discharge outlet 25*x*. As illustrated in FIG. 2, the sheet support surface 29*a* is formed in dimension with a length shorter than the length of the sheet in the sheet discharge direction, and supports the trailing edge portion of the sheet to be discharged from the sheet discharge outlet 25*x*, while the leading edge portion of the sheet is supported (bridge-supported) on the uppermost sheet on the stack tray 21.

Sheet edge regulating means 32 is provided to the process tray 29. The sheets discharged from the sheet discharge outlet 25*x* are switched back, and trailing edges (or it may be leading edges) of the sheets from the sheet discharge outlet 25*x* are aligned by being hit against the sheet edge regulating means 32. Above the process tray 29, there are arranged switchback rollers (first friction rotating members) 26 which convey, to the sheet edge regulating means 32, the sheet-shaped recording media conveyed onto the tray, aligning means 51, and side aligning means 34. The switchback rollers 26 include a drive roller 26*a* and a driven roller 26*b*.

The stack tray (raising and lowering tray) 21 is adapted to be raised and lowered according to the amount of the stacked sheets. The raising and lowering tray 21 is formed in the shape of a tray for stacking thereon sheet-shaped recording media and is adapted to protrude outside the apparatus from a side wall of the casing 20. Therefore, a proximal end portion of the tray has guide rotatable members at two points of upper and lower portions thereof and the guide rotatable members fit in and are supported by a raising and lowering guide provided in an apparatus frame (not shown).

The second processing portion BX2 includes a stacking guide 45 disposed in the second conveyance path P2, a saddle stitching staple unit 40 disposed on the stacking guide 45, a folding processing mechanism (center-folding unit) 44, and a trimmer unit (cutting unit) 90. In the following, the stacking guide 45, the saddle stitching staple unit 40, the folding processing mechanism 44, and the trimmer unit (cutting unit) 90 are described in the stated order.

[Stacking Guide]

The stacking guide 45 is disposed continuously downstream of the second conveyance path P2 and is adapted to stack and store the sheet-shaped recording media from the inlet port 23*a* in succession in an upright position. In particular, the stacking guide 45 illustrated in FIG. 2 is disposed substantially perpendicularly so as to run longitudinally in the casing 20 and is adapted to stack the sheet-shaped recording media in an upright position. This enables formation of a space-saving and compact apparatus. Further, the stacking guide 45 is formed of a guide plate which is bent at the center. The stacking guide 45 is formed so as to have enough length to store therein sheet-shaped recording media of a maximum size and is curved or bent so as to protrude to a side where the saddle stitching staple unit 40 and the folding processing mechanism 44, which are described later, are disposed. The stacking guide 45 is provided with a leading edge stopper 43 for restricting leading edges of the sheets. The position of the leading edge stopper 43 is adapted to move according to the sheet size (length in a direction of delivery).

[Saddle Stitching Staple Unit]

The saddle stitching staple unit (hereinafter referred to as a "saddle stitching unit") 40 is disposed on the stacking guide 45 so as to staple a center portion of the sheet bunch stacked on the stacking guide 45 in registration. More specifically, the sheet post-processing apparatus B according to this embodiment includes the saddle stitching unit 40 for performing saddle stitching in order to prepare the half-folded sheet bunch which is folded about a half-folded portion in the shape of a brochure. A sheet cutting apparatus which is described below is provided so as to be connected to the saddle stitching unit 40. A structure of the saddle stitching unit 40 is described with reference to FIGS. 3A and 3B.

Figure 3A:
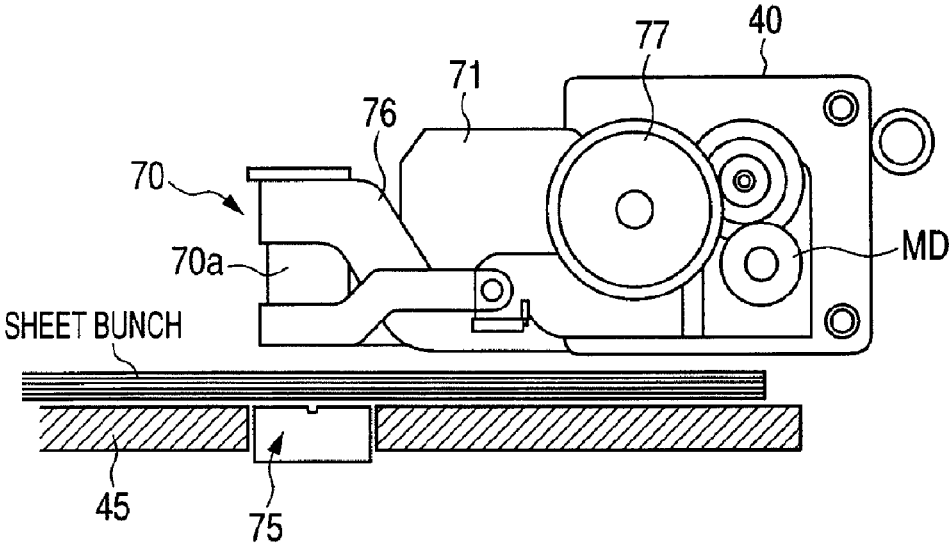
Figure 3B:
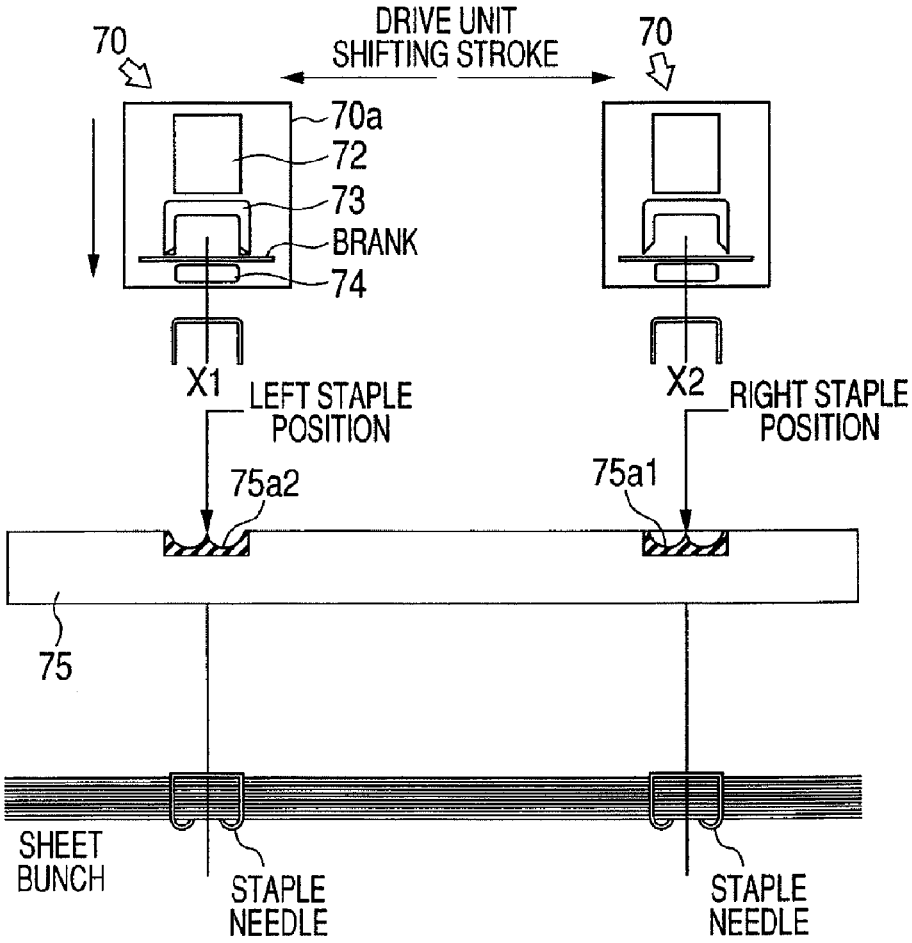

The saddle stitching unit 40 includes a driver 70 and a clincher 75. The driver 70 includes a head member 70*a* for inserting a staple needle into the sheet bunch set at a staple position, a cartridge 71 for storing staple needles, a drive cam 77, and a staple motor MD for driving the drive cam 77. As illustrated in FIG. 3B, the head member 70*a* of the frame of the driver 70 has a drive member 72, a former 73, and a bending block 74 built in the head member 70*a* in the stated order from the top to the bottom. The drive member 72 and the former 73 are vertically slidably supported by the head member 70*a* so as to vertically reciprocate between a top dead center and a bottom dead center. The bending block 74 is fixed to the head member 70*a* as a shaping die for bending a linear staple needle into a shape of a square bracket.

The cartridge 71 storing staple needles therein is attached to the inside of the frame, and supplies the staple needles to the bending block 74 in succession. The drive member 72 and the former 73 are coupled to a drive lever 76 which is oscillatably attached to the frame and are driven to move vertically between the top dead center and the bottom dead center. The frame is provided with an energy-storing spring (not shown) for vertically driving the drive lever 76. The drive cam 77 for storing energy in the energy-storing spring and the staple motor MD for driving the drive cam 77 are also provided.

The clincher 75 is disposed at a position which is opposed to the driver 70 with the sheet bunch sandwiched therebetween. As illustrated in FIG. 3A, the clincher 75 is formed as a structure which is separated from the driver 70, and bends the tips of a staple needle which is inserted into the sheet bunch by the driver 70. Therefore, the clincher 75 includes bending grooves (anvils) 75*a*1 and 75*a*2 for bending the tips of a staple needle. In particular, as illustrated in FIG. 3B, multiple bending grooves 75*a*1 and 75*a*2 of the clincher 75 are provided at two or more points in a width direction of the sheet bunch stacked by the stacking guide 45. Multiple places in the width direction of the sheet bunch are stapled by the driver 70 which moves to the positions of the bending grooves 75*a*1 and 75*a*2. Such a structure enables stapling of two points (left and right) of the sheet bunch supported on the stacking guide 45 in a fixed state without moving the clincher 75.

Alternatively, the clincher 75 may adopt a structure in which a wing member (not shown) for bending the tips of a staple needle is provided and the wing member is oscillated and rotated in synchronization with the tips of a staple needle inserted into the sheet bunch by the driver 70. In this case, a pair of bending wings are pivotally supported on the frame of the clincher 75 so as to be oscillatable to a position opposed to the tips of a square-bracket-shaped staple needle, respectively. The pair of the bending wings are oscillated in synchronization with the operation of inserting a staple needle into the sheet bunch by the driver 70. The oscillation of the pair of the wings bends the tips of a staple needle so as to be flat along a rear surface of the sheet bunch. More specifically, the tips of a staple needle are bent so as to be U-shaped (curved clinch) when the former, that is, the bending grooves are used, while the tips of a staple needle are bent flat (flat clinch) when the latter, that is, the wing member is used. In the present invention, either of the structures may be adopted.

When the staple motor MD rotates, the drive cam 77 presses down via the energy-storing spring the drive lever 76 so that the drive lever is moved from the top dead center to the bottom dead center. The descending operation of the drive lever 76 makes the drive member 72 and the former 73 built in the head member 70*a* which are coupled thereto move from the top dead center to the bottom dead center. The drive member 72 is a plate-like member so as to press the back of a staple needle which is bent into the shape of a square bracket. The former 73 is, as illustrated in FIG. 3B, a member which is formed in the shape of a square bracket, and bends a staple needle into the shape of the square bracket together with the bending block 74. More specifically, a staple needle is supplied from the above-mentioned cartridge 71 to the bending block 74. The linear staple needle is press-formed in the shape of the square bracket by the former 73 and the bending block 74, and then, the drive member 72 rapidly presses down the staple needle which is bent into the shape of the square bracket toward the sheet bunch, thereby inserting the staple needle into the sheet bunch.

[Folding Processing Mechanism]

Reference is again made to FIG. 2. A center-folding unit 44 including folding roller means 46 for folding the sheet bunch and a folding blade 47 for inserting the sheet bunch into a nip position of the folding roller means 46 is provided at a folding position disposed downstream of the saddle stitching unit 40. As illustrated particularly in FIG. 4A, the folding roller means 46 includes a pair of folding rollers (roller members) 46*a* and 46*b* which are in pressure contact with each other. The entire length of the folding rollers 46*a* and 46*b* is adapted to be substantially equal to the width of a sheet of a substantially maximum size.

The pair of the folding rollers 46*a* and 46*b* are formed of a material having a large friction coefficient, such as rubber. This is for the purpose of conveying the sheet-shaped recording media by soft materials, such as rubber in the direction of rotation while bending the sheet-shaped recording media. The pair of the folding rollers 46*a* and 46*b* may be formed by lined (coated) with a rubber material. A gap having unevenness (recesses and protrusions) which extends in the width direction of the sheet is formed on the folding rollers 46*a* and 46*b*. The gap is disposed so as to conform to unevenness (recesses and protrusions) of a tip of the folding blade 47 to be described later for the purpose of making easier the insertion of the tip of the folding blade 47 into a nip formed by the rollers. More specifically, the pair of the folding rollers 46*a* and 46*b* which are in pressure contact with each other are formed in an uneven shape (recesses and protrusions) having a gap in the width direction of the sheet so that portions of the half-folded sheet bunch which are stapled and the tip of the folding blade 47 which is formed in an uneven shape (recesses and protrusions) are inserted into the gap.

Operation of folding the sheet-shaped recording media by the folding roller means 46 is now described with reference to FIGS. 4A to 4D. The folding blade 47 having a knife edge is provided at a position opposed to the pair of the folding rollers 46*a* and 46*b* with the sheet bunch supported on the stacking guide 45 being sandwiched therebetween. The folding blade 47 is supported by the apparatus frame so as to reciprocate between a standby position illustrated in FIG. 4A and a nip position illustrated in FIG. 4C.

Figure 4A:
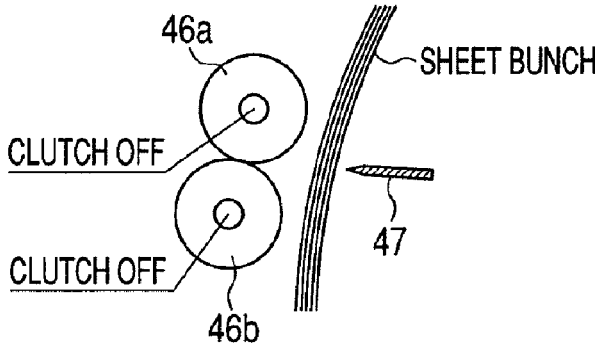

The sheet bunch supported on the stacking guide 45 in the shape of a bunch is engagingly stopped by the leading edge stopper 43 in the state illustrated in FIG. 4A, and, with the position of the fold being stapled, positioned at the folding position. When a completion signal of setting the sheet bunch is obtained, drive control means (sheet bunch folding operation control portion to be described later) 164*d* turns off clutch means.

Figure 4B:
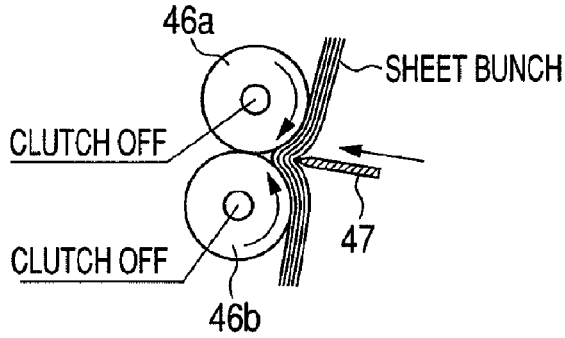
Figure 4C:
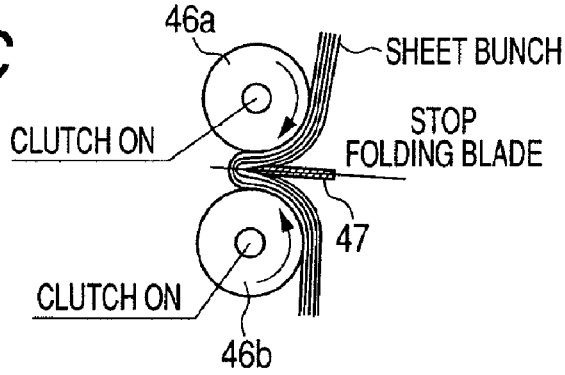
Figure 4D:
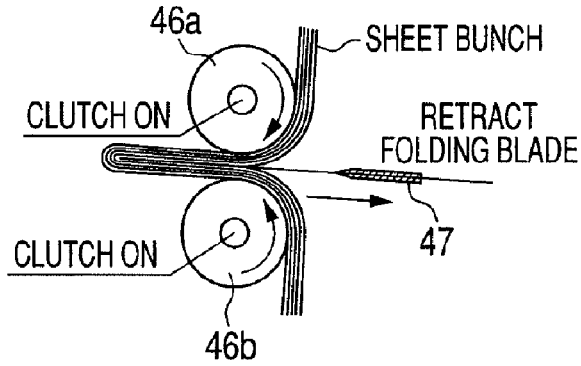

Then, the drive control means 164*d* moves the folding blade 47 from the standby position toward the nip position at a predetermined speed. As illustrated in FIG. 4B, the position of the fold of the sheet bunch is bent by the folding blade 47 and is inserted between the folding rollers 46*a* and 46*b*. Here, the folding rollers 46*a* and 46*b* are driven to rotate together with the sheets which are moved by the folding blade 47. The drive control means 164*d* stops a blade drive motor (not shown) after a likely time period for the sheet bunch to reach a predetermined nip position elapses, and stops the folding blade 47 at a position illustrated in FIG. 4C. Substantially in parallel with this, the drive control means 164*d* turns on the clutch means to drive the folding rollers 46*a* and 46*b* to rotate. Then, the sheet bunch is sent in a feeding direction (to the left side of FIG. 4D). After that, as illustrated in FIG. 4D, the drive control means 164*d* moves and returns the folding blade 47 positioned at the nip position toward the standby position in parallel with the feeding of the sheet bunch by the folding rollers 46*a* and 46*b*.

When the half-folded sheet bunch which is folded in this way is first caught in the pair of the folding rollers 46*a* and 46*b*, a sheet of the sheet bunch which is in contact with surfaces of the pair of the rollers is not drawn between the rollers by the rotating rollers. More specifically, because the folding rollers 46*a* and 46*b* follow (are driven by) the inserted (pushed) sheet bunch and are rotated, that only a sheet-shaped recording medium in contact with the rollers is first caught in the nip between the rollers does not occur. Further, because the rollers follow the inserted sheet bunch and are driven to rotate, a sheet in contact with the surfaces of the rollers is not rubbed and a blurred image is not formed.

[Trimmer Unit]

A trimmer unit (a sheet cutting apparatus) 90 including a cutting member configured to cut and align edge portions (fore edge) of the spread of the half-folded sheet bunch which is guided to be conveyed to the saddle tray (second stack tray) 22 is disposed downstream of the folding processing mechanism 44 of the second processing portion BX2 structured in this way in a sheet-bunch conveying direction SX (on the left side of FIG. 2). The trimmer unit 90 forms the sheet cutting apparatus, and includes a trimmer inlet roller pair 201 and a bunch pressing roller 202*b* as a conveying member configured to convey a half-folded sheet bunch T which is folded about a half-folded portion in the shape of a brochure, a registration unit 210 as a registration member for making skew feed correction of the half-folded sheet bunch T, a cutting member 204 for cutting and aligning edge portions of the half-folded sheet bunch T, and a discharge roller 203 as a discharging member provided at an outlet of the apparatus and configured to discharge the sheet bunch. More specifically, because, when a bunch of multiple sheets is folded at the center so as to be in the shape of a brochure in the above-mentioned folding processing mechanism 44, the edge portions (fore edge) of the folded bunch become unaligned, the edge portions (fore edge) of the half-folded sheet bunch folded by the folding processing mechanism 44 is cut off by a predetermined amount by the trimmer unit 90 as the sheet cutting apparatus, thereby finishing the half-folded sheet bunch so as to have aligned edge portions.

Figure 5:
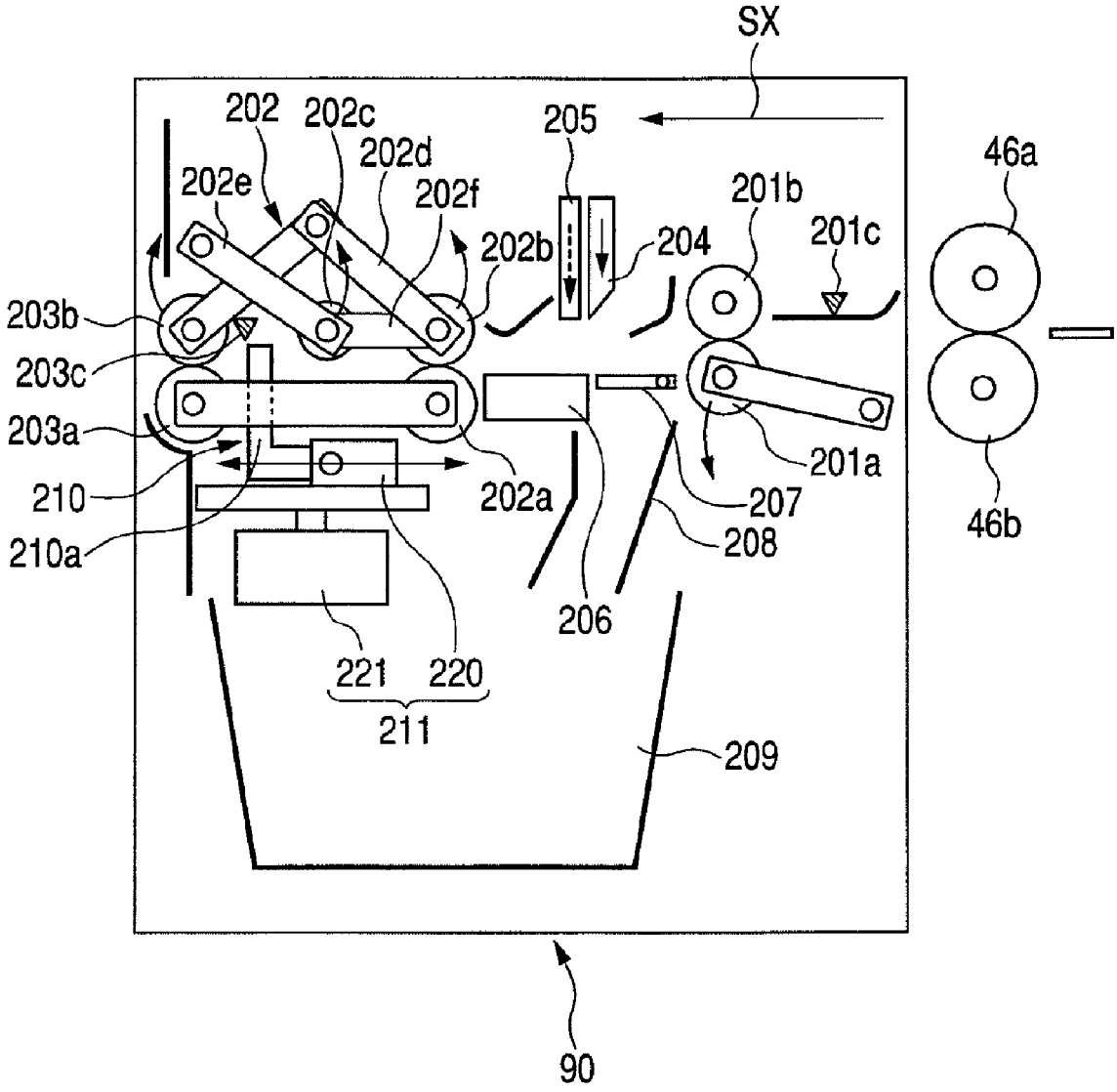
FIG. 5 is an explanatory partial enlarged side view illustrating a whole structure of a trimmer unit (sheet cutting apparatus) according to an embodiment of the present invention.

The trimmer unit (sheet cutting apparatus) 90 has, for example, a schematic structure illustrated in FIG. 5. More specifically, the half-folded sheet bunch folded about the half-folded portion in the shape of a brochure by the folding operation of the folding roller pair 46*a* and 46*b* of the above-mentioned folding processing mechanism 44 is passed-over from the side of the half-folded portion of the half-folded sheet bunch to a trimmer inlet roller pair 201*a* and 201*b* (conveying members) and is conveyed substantially horizontally to a predetermined position by the trimmer inlet roller pair 201*a* and 201*b*. The half-folded sheet bunch at that time is detected by an inlet sensor 201*c*. After that, the skew feed correction operation by the registration unit 210 as the registration member configured to correct a skew feed of the half-folded sheet bunch, bunch pressing operation by bunch pressing means 202, and sheet bunch cutting operation by the cutting member 204 configured to cut and align the edge portions of the half-folded sheet bunch are performed. After the edge portions (fore edge) of the half-folded sheet bunch are substantially linearly cut by the cutting member 204, the half-folded sheet bunch is finally discharged to the saddle tray 22 as a stack tray by a sheet discharging roller pair 203*a* and 203*b* as a discharging member provided at the outlet of the apparatus. The half-folded sheet bunch at that time is detected by an outlet sensor 203*c*.

[Cutting of Center-Folded Sheet Bunch of Small-Size Sheets]

Figure 6A:
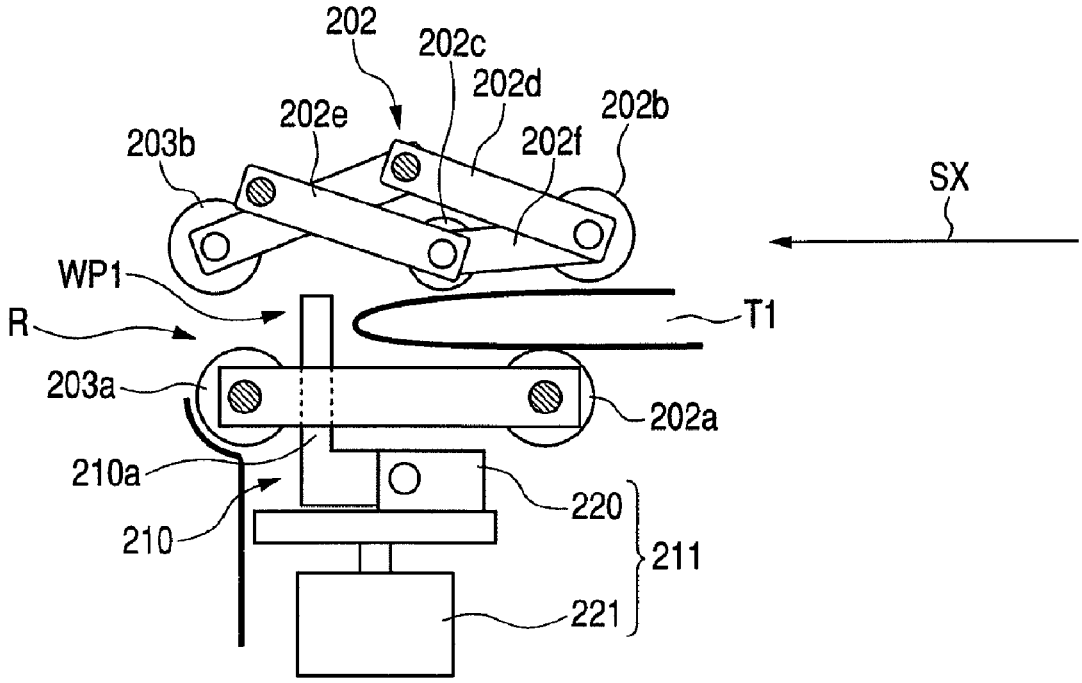

Here, a structure of the trimmer unit (sheet cutting apparatus) 90 is described according to the above-mentioned respective operations. The trimmer unit 90 is adapted to perform the sheet bunch skew feed correction operation illustrated in FIGS. 6A and 6B and the bunch pressing operation illustrated in FIGS. 6C and 6D. With reference to FIGS. 6A to 6D, the cutting operation of a half-folded sheet bunch of small-size sheets (smaller than a predetermined size of a sheet) is described. In the embodiment, the predetermined size is A3 (297 mm×420 mm) of JIS. FIG. 6A illustrates a state in which a half-folded sheet bunch T1 which comes out of the nip between the folding roller pair 46*a* and 46*b* is conveyed to the trimmer unit 90 in the sheet-bunch conveying direction SX by the trimmer inlet roller pair 201*a* and 201*b*. The registration unit 210 is moved from the retracting position below the conveyance path so as to be on standby at a standby position (first standby position) WP1 for a small size. In FIG. 6A, the half-folded portion at the leading end of a half-folded sheet bunch T1 is conveyed to a position in proximity of the registration unit 210 as the registration member and is stopped.

Figure 6B:
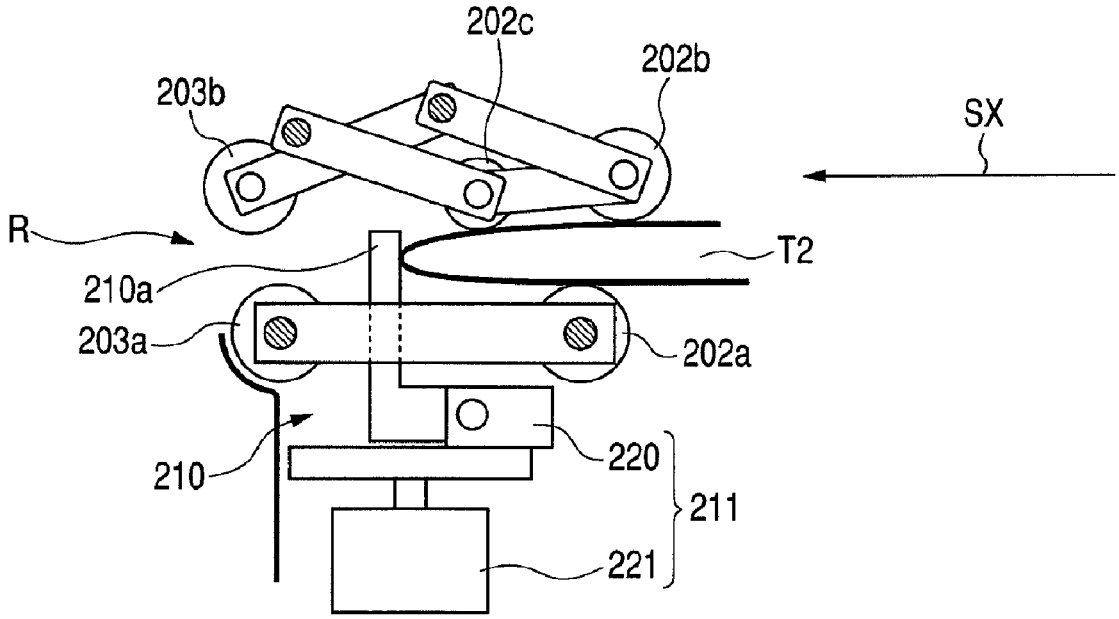
Figure 6C:
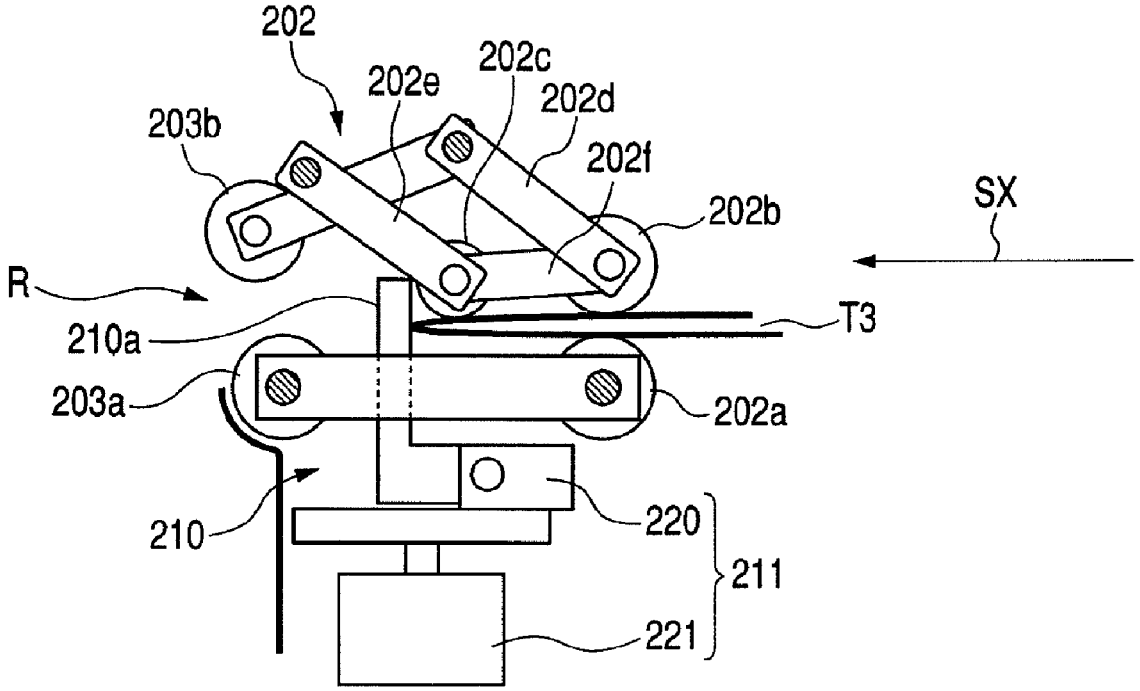
Figure 6D:
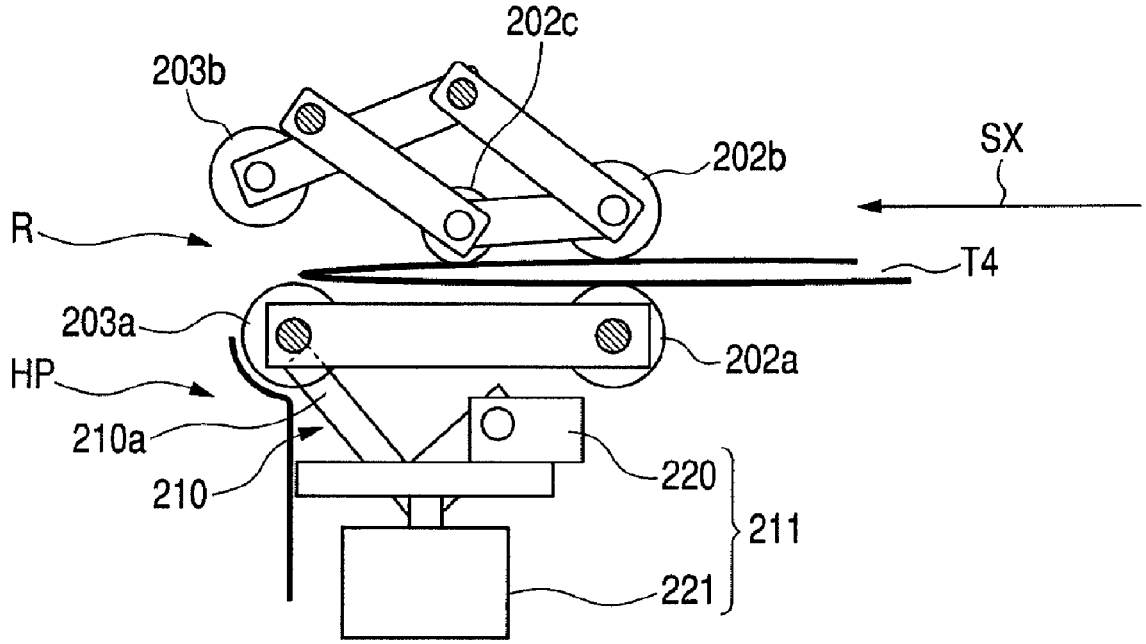
Figure 14:
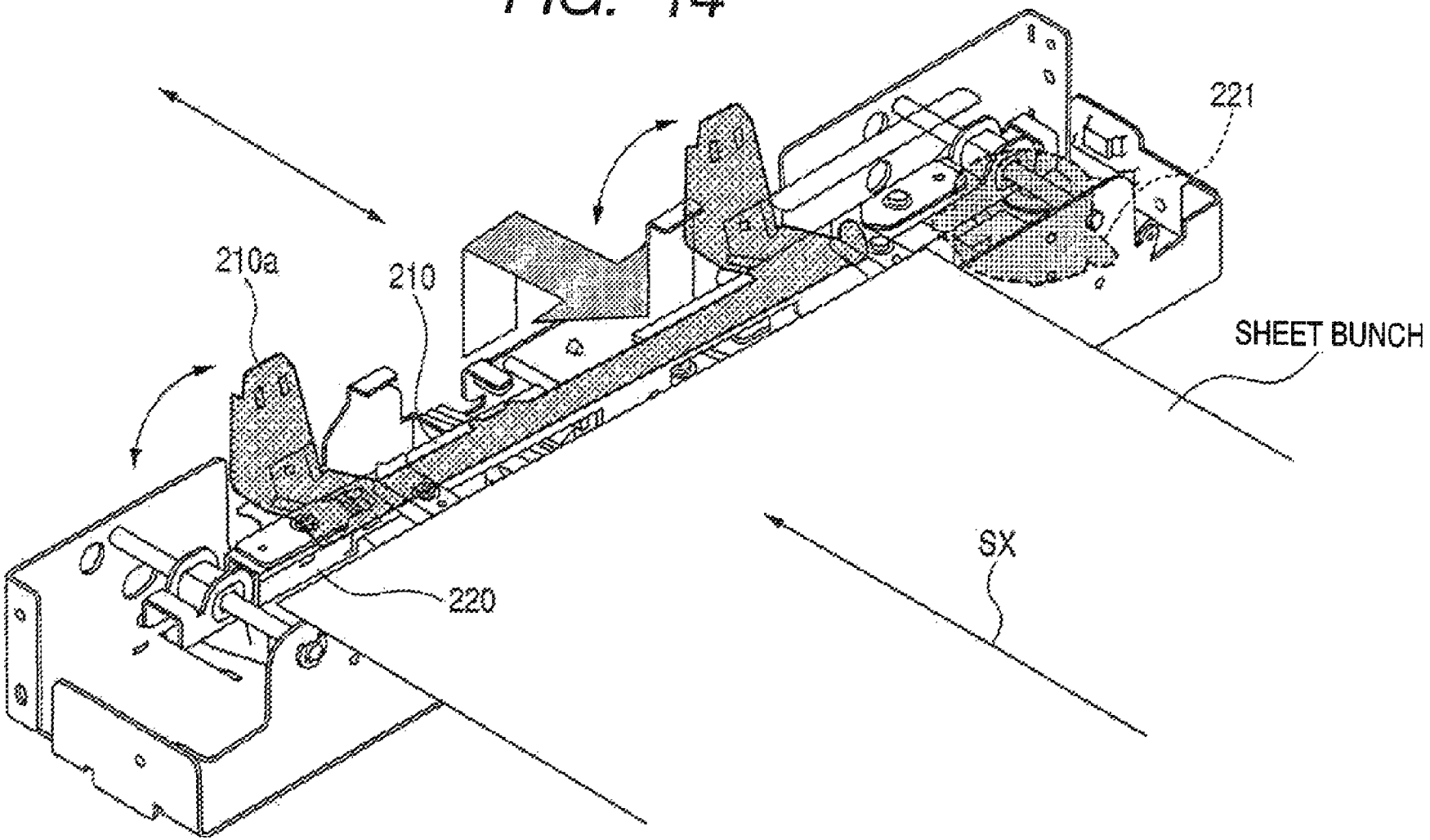
FIG. 14 is an explanatory perspective view illustrating a positional relationship between a registration unit and the sheet bunch.

The registration unit 210 as the registration member has a standing wall portion 210*a* against which a half-folded portion of the half-folded sheet bunch T1 is hit. The standing wall portion 210*a* is rotatably attached so as to tilt from an acting position (first standby position or registration operating position) as illustrated in FIGS. 6A to 6C at which the standing wall portion 210*a* protrudes into a conveyance path R of the half-folded sheet bunch T1 to a non-acting position (retracting position) as illustrated in FIG. 6D at which the standing wall portion 210*a* retracts from the conveyance path R of the half-folded sheet bunch T1. FIG. 14 is a perspective view of the registration unit 210. The tilting operation and the standing operation, which is the opposite thereof, of the standing wall portion 210*a* are performed by turning on/off a registration solenoid 220. The registration unit 210 is provided so as to reciprocate in the sheet-bunch conveying direction SX of the half-folded sheet bunch T1. By forward rotation or reverse rotation by a predetermined amount of a registration motor 221 provided in a registration drive portion 211 of the registration unit 210, the registration unit 210 is adapted to reciprocate in a right-left direction of FIGS. 6A to 6D along the sheet-bunch conveying direction SX to move to the first standby position WP1.

Figure 7:
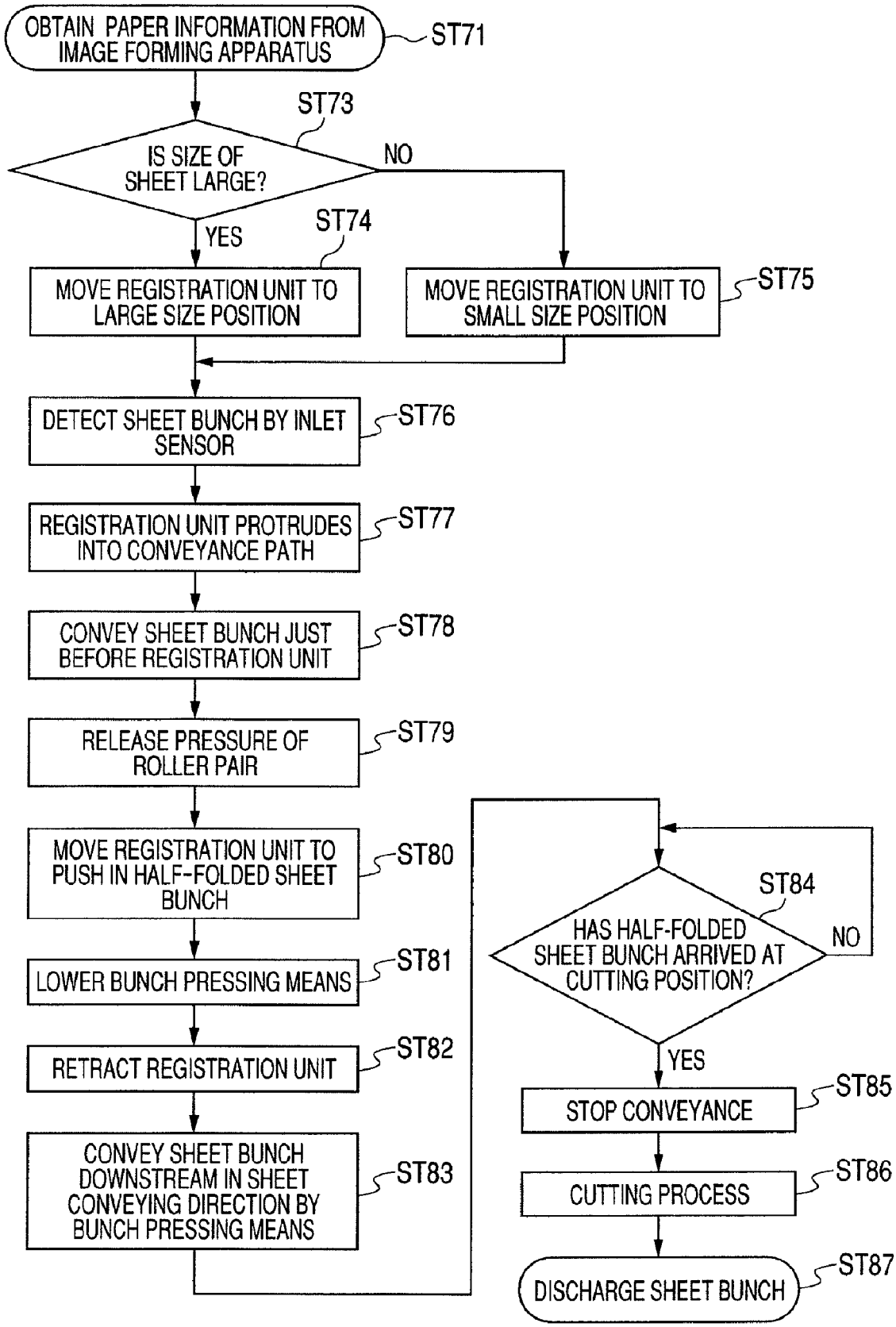
FIG. 7 is a flow chart illustrating control steps of the skew feed correction operation of the half-folded sheet bunch by the trimmer unit (sheet cutting apparatus).

FIG. 7 is a flow chart illustrating control steps of the skew feed correction operation of the half-folded sheet bunch by the trimmer unit (sheet cutting apparatus). A registration operation control portion 164*e* of a post-processing control portion 160 as shown in FIG. 11 described later obtains from the image forming apparatus A paper information with regard to the sheet-shaped recording media (Step ST71) and discriminates between large-size sheets and small-size sheets, for example, whether the sheet size is large (a predetermined size or larger) or small (smaller than the predetermined size) (Step ST73). In the embodiment, the predetermined size is A3 (297 mm×420 mm) of JIS. The registration unit 210 as the registration member is moved from the retracting position below the conveyance path to a standby position corresponding to the sheet size (Steps ST74 and ST75). For example, when the sheet size is large (A3 size or larger), the registration unit 210 is moved to a second standby position WP2 outside the discharging roller illustrated in FIG. 9A to be described later (Step ST74). When the sheet size is small (smaller than A3 size), the registration unit 210 is moved to the first standby position WP1 inside the discharging roller illustrated in FIG. 6A (Step ST75). First, operation in the case of a small size which is smaller than A3 size illustrated in FIGS. 6A to 6D is described.

At Step ST73, when the result of the discrimination is that the sheet size is small (smaller than A3 size), the registration unit 210 is moved to the first standby position WP1 illustrated in FIG. 6A (Step ST75). After the half-folded sheet bunch is detected by the inlet sensor 201*c* (Step ST76 of FIG. 7), the standing wall portion 210*a* is made to be in a protruding state into the conveyance path R as illustrated in FIG. 6A (Step ST77). The skew feed correction of a half-folded sheet bunch T2 is made when the registration unit 210 moves from the first standby position WP1 to the right side as illustrated in FIG. 6B. More specifically, the half-folded sheet bunch T1 is conveyed by the trimmer inlet roller pair 201*a* and 201*b* as the conveying member so as to be close as 5 mm forward of the standing wall portion 210*a* of the registration unit 210 disposed at the first standby position WP1 illustrated in FIG. 6A (Step ST78). After that, the pressure applied to the trimmer inlet roller pair 201*a* and 201*b* is released (Step ST79).

Then, the standing wall portion 210*a* of the registration unit 210 moves from the first standby position WP1 illustrated in FIG. 6A to the right side and, as illustrated in FIG. 6B, the standing wall portion 210*a* is hit against a half-folded portion of the half-folded sheet bunch T2. When the registration unit 210 is further pushed in from the state of being hit against the half-folded portion toward an upstream side in the sheet-bunch conveying direction SX (Step ST80), the half-folded sheet bunch T2 conforms to the standing wall portion 210*a* of the registration unit 210, which makes the skew feed correction of the half-folded sheet bunch T2.

The amount of the half-folded sheet bunch T2 which is pushed in by the registration unit 210 in order to make such skew feed correction is set to be, for example, about 10 mm. If the skew feed correction operation by pushing in the half-folded sheet bunch T2 by the registration unit 210 is made twice or more, the skew feed is corrected with more reliability. Further, if the number of times of the skew feed correction operation made by the registration unit 210 is adapted to be increased/decreased according to the thickness of the half-folded sheet bunch T2, that is, the number of the sheets, necessary and sufficient skew feed correction operation can be performed.

As illustrated in FIG. 6C, by lowering the bunch pressing means 202 (Step ST81), bunch pressing operation is performed with regard to the half-folded sheet bunch T2 after the skew feed is corrected in this way. The bunch pressing means 202 includes a bunch pressing roller 202*b* and a bunch pressing rotatable member 202*c* for flattening a bulge of the half-folded sheet bunch T2. The bunch pressing roller 202*b* and the bunch pressing rotatable member 202*c* are vertically movably supported by rotating arms 202*d* and 202*e* which are bar-like members. The bunch pressing roller 202*b* and the bunch pressing rotatable member 202*c* are coupled to each other via a linkage rod 202*f*. As illustrated in FIGS. 6B and 6C, both of the bunch pressing roller 202*b* and the bunch pressing rotatable member 202*c* are lowered to press the bulge of the half-folded sheet bunch T2 from above to form a half-folded sheet bunch T3 with air removed therefrom.

Here, if only the bunch pressing roller 202*b* presses the half-folded sheet bunch T2, the half-folded sheet bunch T2 is only pressed linearly, which results in a bulge at a portion of the half-folded sheet bunch T2 between the bunch pressing roller 202*b* and the standing wall portion 210*a* of the registration unit 210, unsuccessful bunch pressing, and poor cutting in a cutting process to be described later. On the other hand, in this embodiment, because, as described above, both of the bunch pressing roller 202*b* and the bunch pressing rotatable member 202*c* are adapted to press, pressing action which is substantially similar to that in a case in which the half-folded sheet bunch T2 is pressed by a sheet-shaped member can be attained, which enables a sufficient purge of air with reliability. More specifically, the above-mentioned bunch pressing rotatable member 202*c* is disposed at a position which substantially corresponds to the top of the bulge of the half-folded sheet bunch T2, while the bunch pressing roller 202*b* is disposed at a position a little away from the bunch pressing rotatable member 202*c* toward the edge portions (fore edge) of the half-folded sheet bunch (to the right side of FIG. 6C).

Further, the above-mentioned bunch pressing roller 202*b* and bunch pressing rotatable member 202*c* are rotatably attached so as to form a conveying member configured to convey a half-folded sheet bunch T4 folded about a half-folded portion in the shape of a brochure. More specifically, with the bunch pressing roller 202*b* and the bunch pressing rotatable member 202*c* performing the bunch pressing operation as illustrated in FIG. 6D, the standing wall portion 210*a* of the registration unit 210 is retracted from the conveyance path R to a retracting position HP (Step ST82). After that, the conveying member (202*b* and 202*c*) conveys the half-folded sheet bunch T4 by a predetermined amount toward an outlet of the apparatus (to the left side of FIG. 6D) while pressing the bunch (Step ST83). By conveying the half-folded sheet bunch T4 while pressing the bunch by the bunch pressing roller 202*b* and the bunch pressing rotatable member 202*c* as the conveying member, not only the process time is shortened to improve the productivity but also the sheet bunch T4 can be pushed in so that air is sufficiently removed from within the half-folded sheet bunch T4, and thus, the cutting operation to be described later can be performed promptly and satisfactorily (Step ST86). Further, because the amount of the sheet bunch which is cut off in the cutting operation to be described later is determined by the amount of conveyance here, the finished size can be freely changed by changing the amount of conveyance.

Next, the cutting process will be described together with a structure of the cutting member 204. In this embodiment, cutting by the cutting blade 204 as the cutting member is adapted to be performed after the half-folded portion (the leading edge portion in the sheet-bunch conveying direction SX) of the half-folded sheet bunch T4 after the skew feed correction by the registration unit 210 as the registration member is conveyed by the conveying member to be positioned so as to protrude outside the apparatus and outside the sheet discharging roller pair 203*a* and 203*b* as discharging means. A cutting operation control portion 164*f* of the post-processing control portion 160 determines whether or not the half-folded sheet bunch is conveyed to a cutting position (Step ST84). If the half-folded sheet bunch is conveyed to the cutting position (YES of Step ST84), the conveyance by the conveying member (202*b* and 202*c*) is stopped (Step ST85).

The fore edge of the half-folded sheet bunch is cut by the cutting member 204 (Step ST86). More specifically, the cutting operation of the sheet bunch and discharging operation of scraps are performed by the cutting blade 204 as the cutting member which is driven by a motor (not shown) and a sheet retainer 205 which is driven in synchronization therewith as, for example, illustrated in FIGS. 8A and 8B. The cutting blade 204 and the sheet retainer 205 are disposed between the above-mentioned trimmer inlet roller pair 201*a* and 201*b* and the bunch pressing means 202. The cutting blade 204 together with a lower blade 206 disposed below is adapted to perform shearing action to cut a sheet bunch T5 like a pair of scissors.

Figure 8A:
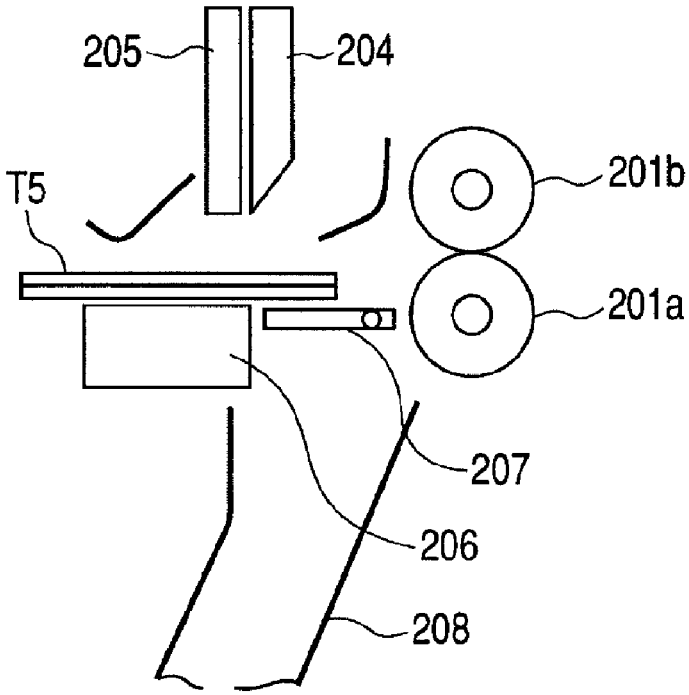
Figure 8B:
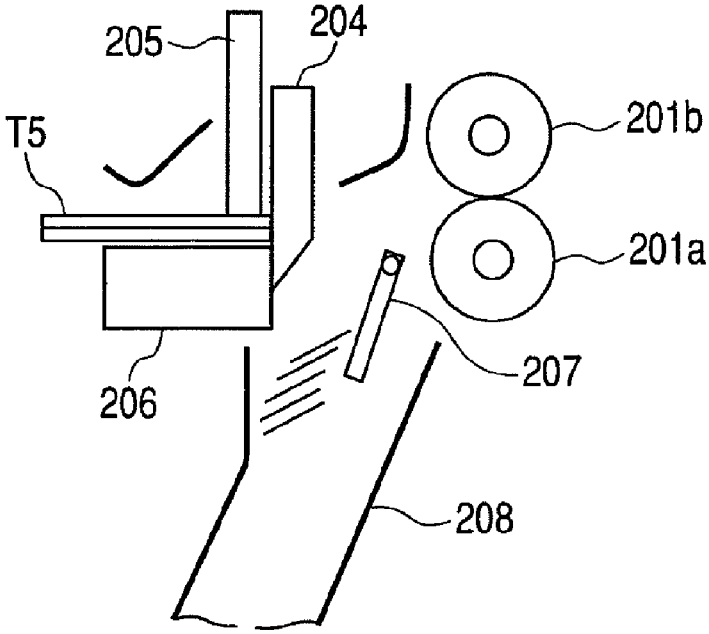

Further, a scrap flapper 207 is disposed upstream of the lower blade 206 in the sheet-bunch conveying direction SX (to the right side of FIG. 8A) so as to be in proximity to the lower blade 206. The scrap flapper 207 is disposed at an upper end position of a scrap chute 208 and is adapted to rotate downward in synchronization with the cutting operation by the cutting blade 204. More specifically, before the cutting, as illustrated in FIG. 8A, the scrap flapper 207 is held substantially horizontally to act as the conveyance path R of the half-folded sheet bunch T5. The half-folded sheet bunch T5 is stopped at the cutting position and the fore edge of the half-folded sheet bunch T5 comes immediately below the cutting blade 204. In the cutting operation illustrated in FIG. 8B, the scrap flapper 207 is rotated downward to serve to guide via the scrap chute 208 cut scraps which are generated in the cutting so that the cut scraps fall down into a scrap container 209 disposed below.

The cut half-folded sheet bunch T5 is discharged to the saddle tray 22 by the sheet discharging roller pair 203*a* and 203*b* as the discharging means (Step ST87).

[Cutting of Half-Folded Sheet Bunch of Large-Size Sheets]

Figure 9A:
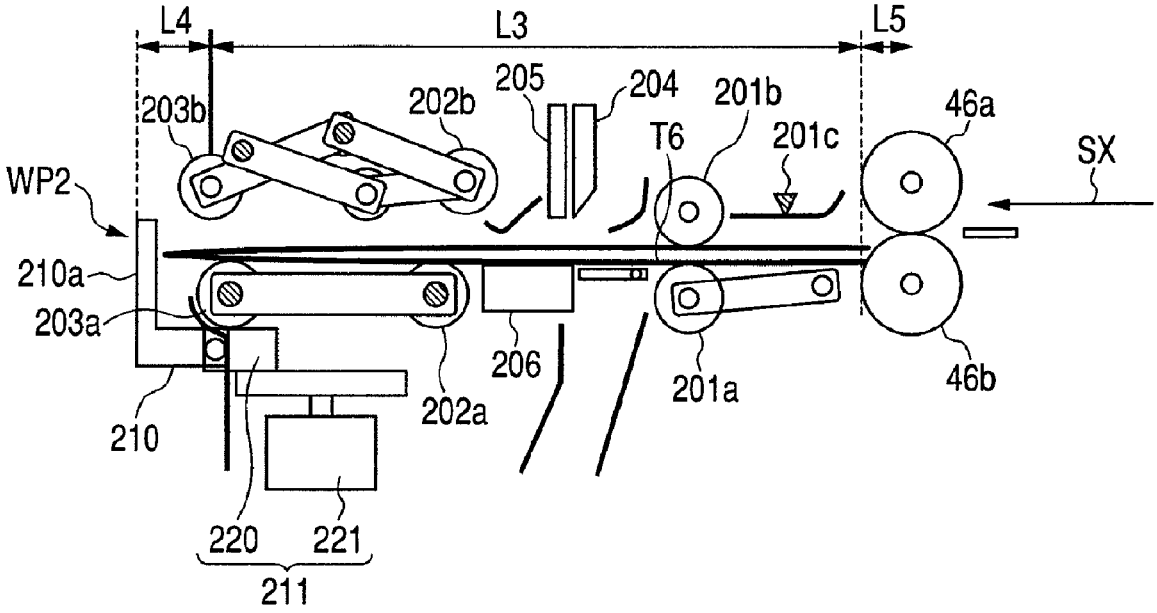
Figure 9B:
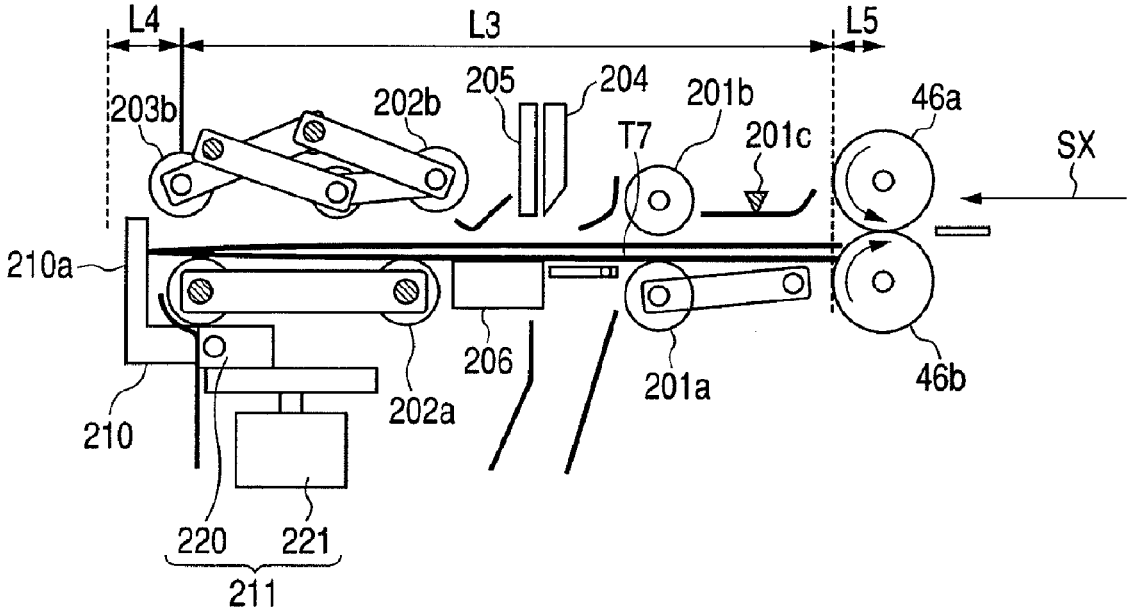
Figure 9C:
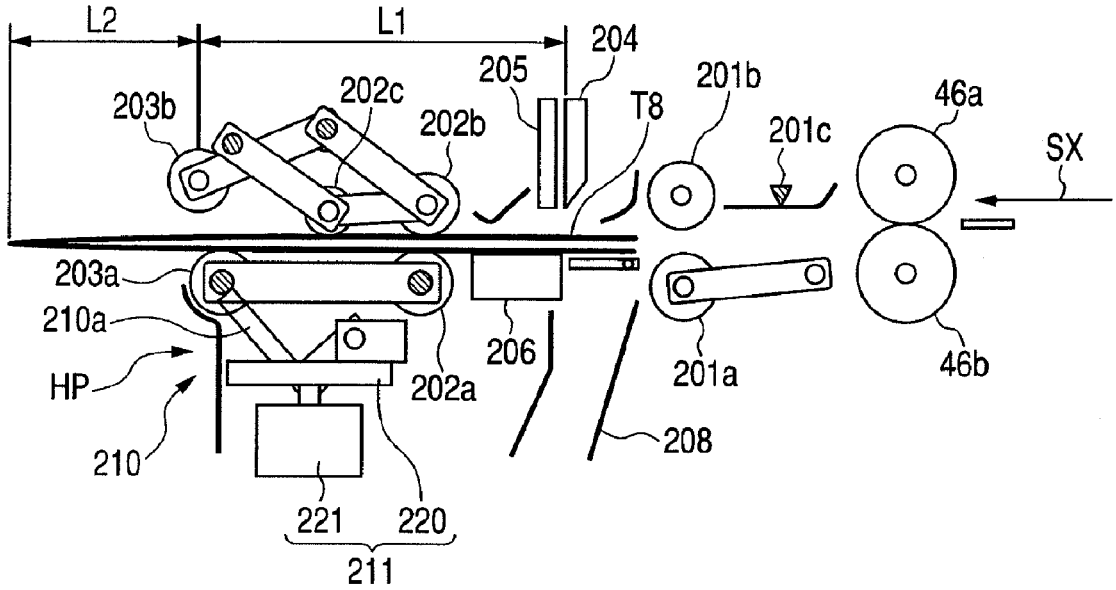
Figure 9D:
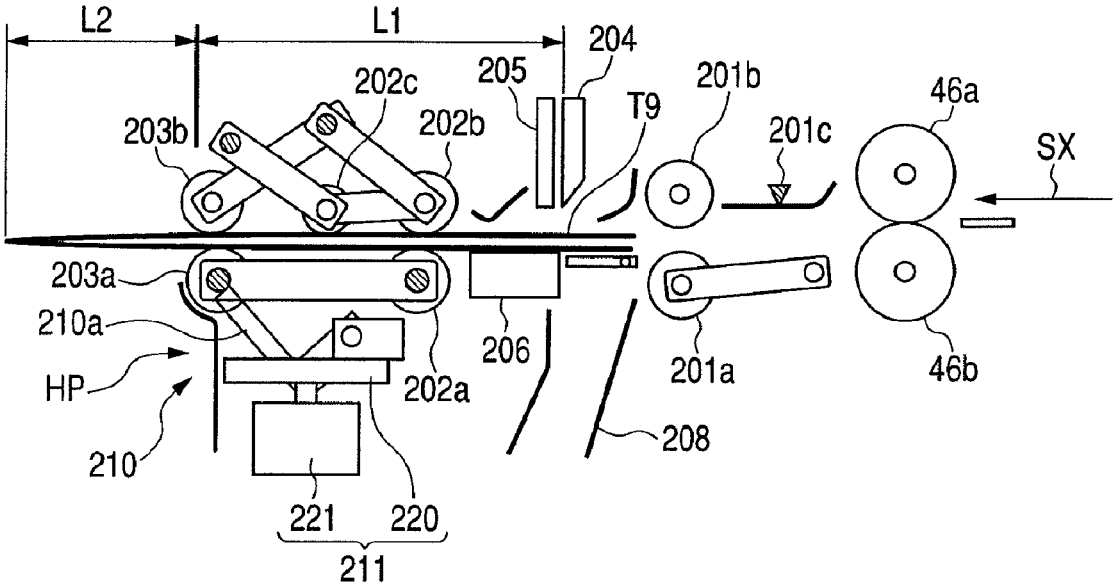

At Step ST73, when the result of the discrimination is that the sheet size is large (the predetermined size or larger), the registration unit 210 is moved to the second standby position WP2 illustrated in FIG. 9A (Step ST74). In the embodiment, the predetermined size is A3 (297 mm×420 mm) of JIS. The second standby position WP2 is downstream of the discharging member (203*a* and 203*b*) in the sheet-bunch conveying direction SX and outside of the trimmer unit (the sheet cutting apparatus). After the half-folded sheet bunch is detected by the inlet sensor 201*c* (Step ST76 of FIG. 7), the standing wall portion 210*a* is made to be in a protruding state into the conveyance path R as illustrated in FIG. 9A (Step ST77). The half-folded sheet bunch T1 is conveyed by the trimmer inlet roller pair 201*a* and 201*b* as the conveying member so as to be close as 5 mm forward of the standing wall portion 210*a* of the registration unit 210 disposed at the second standby position WP2 illustrated in FIG. 9A (Step ST78). After that, the trimmer inlet roller pair 201*a* and 201*b* are separated from each other so that the pressure applied to the trimmer inlet roller pair 201*a* and 201*b* is released (Step ST79) (FIG. 9B). The skew feed correction of a half-folded sheet bunch T7 is made when the registration unit 210 moves from the second standby position WP2 to the right side as illustrated in FIG. 9B. The standing wall portion 210*a* of the registration unit 210 moves from the second standby position WP2 illustrated in FIG. 9A to the right side and, as illustrated in FIG. 9B, the standing wall portion 210*a* is hit against a half-folded portion of the half-folded sheet bunch T7. When the registration unit 210 is further pushed in from the state of being hit against the half-folded portion toward an upstream side in the sheet-bunch conveying direction SX (Step ST80), the half-folded sheet bunch T7 conforms to the standing wall portion 210*a* of the registration unit 210, which makes the skew feed correction of the half-folded sheet bunch T7. By lowering the bunch pressing means 202 (Step ST81), bunch pressing operation is performed with regard to the half-folded sheet bunch T7 after the skew feed correction into a half-folded sheet bunch T8 from which air has been removed. The standing wall portion 210*a* of the registration unit 210 is retracted from within the conveyance path R to the retracting position HP (Step ST82). The bunch pressing roller 202*b* and the bunch pressing rotatable member 202*c* as the conveying member convey the half-folded sheet bunch T8 by a predetermined amount toward the outlet of the apparatus (to the left side of FIG. 9C) while pressing the half-folded sheet bunch T8 (Step ST83) as illustrated in FIG. 9C. The cutting operation control portion 164*f* of the post-processing control portion 160 determines whether or not the half-folded sheet bunch is conveyed to the cutting position (Step ST84). If the half-folded sheet bunch is conveyed to the cutting position (YES of Step ST84), the conveyance by the conveying member (202*b* and 202*c*) is stopped (Step ST85). The fore edge of the half-folded sheet bunch is cut by the cutting member 204 (Step ST86) (FIG. 9D). As illustrated in FIG. 9D, a cut half-folded sheet bunch T9 is discharged to the saddle tray 22 by the sheet discharging roller pair 203*a* and 203*b* as the discharging means (Step ST87).

As illustrated in FIGS. 9A-9D, when the half-folded sheet bunch of a large size (A3 size or larger) is cut, after the half-folded portion of the half-folded sheet bunch T6 is conveyed so as to protrude outside the apparatus (FIG. 9A), positioning is performed. Cutting by the above-mentioned cutting blade 204 is performed with the half-folded portion of the half-folded sheet bunch T8 during the cutting being outside the apparatus (FIG. 9C).

Let the length of a portion of the half-folded sheet bunch T8 which protrudes outside the apparatus during the cutting be L2 and let the length of a portion of the half-folded sheet bunch T8 which is inside the apparatus and which is on the left side of the cutting blade 204 be L1. In a conventional apparatus, the region of the above-mentioned L1+L2 has to be inside the apparatus without fail, which makes large the apparatus as a whole. On the other hand, in this embodiment, the length of the apparatus as a whole is adapted to be smaller by L2 which is the length of the portion of the half-folded sheet bunch T8 that protrudes outside the apparatus.

As illustrated in FIG. 9A, with regard to a half-folded sheet bunch T6 of a large size (A3 size or larger), the above-mentioned second standby position WP2 of the standing wall portion 210*a* of the registration unit 210 as the registration member is adapted to be set at a position outside the sheet discharging roller pair 203*a* and 203*b* as the discharging means and outside the apparatus. More specifically, when the large-size half-folded sheet bunch T6 is used, the registration unit 210 first protrudes into the conveyance path R, and then, is moved to the second standby position WP2 which is set outside the apparatus and is positioned, and the skew feed correction is made when the registration unit 210 moves from the standby position outside the apparatus toward the inside of the apparatus and to the right side of FIG. 9B (by 10 mm in this embodiment). Let the length of a portion of the half-folded sheet bunch T6 which is inside the apparatus from a point at which the nip between the above-mentioned pair of the folding rollers 46*a* and 46*b* releases the half-folded sheet bunch T6 be L3. In a conventional apparatus, the length of the apparatus which corresponds to L3 has to be equal to or larger than the length of a sheet of a maximum size. On the other hand, in this embodiment, because the standby position of the registration unit 210 protrudes outside the sheet discharging roller pair 203*a* and 203*b* as the discharging means and outside the apparatus, the length of the apparatus as a whole can be made smaller by a length L4 by which the registration unit 210 protrudes. In other words, the distance between the second standby position WP2 of the registration unit 210 which comes into contact with the half-folded sheet bunch T6 and the cutting position of the cutting blade 204 as the cutting member is smaller than the size of the half-folded sheet bunch from the leading edge to the trailing edge. Therefore, the distance between the discharging roller 203 disposed at the outlet of the trimmer unit (the sheet cutting apparatus) and the cutting position of the cutting blade 204 as the cutting member is smaller than the size of the half-folded sheet bunch from the leading edge to the trailing edge.

Figure 10A:
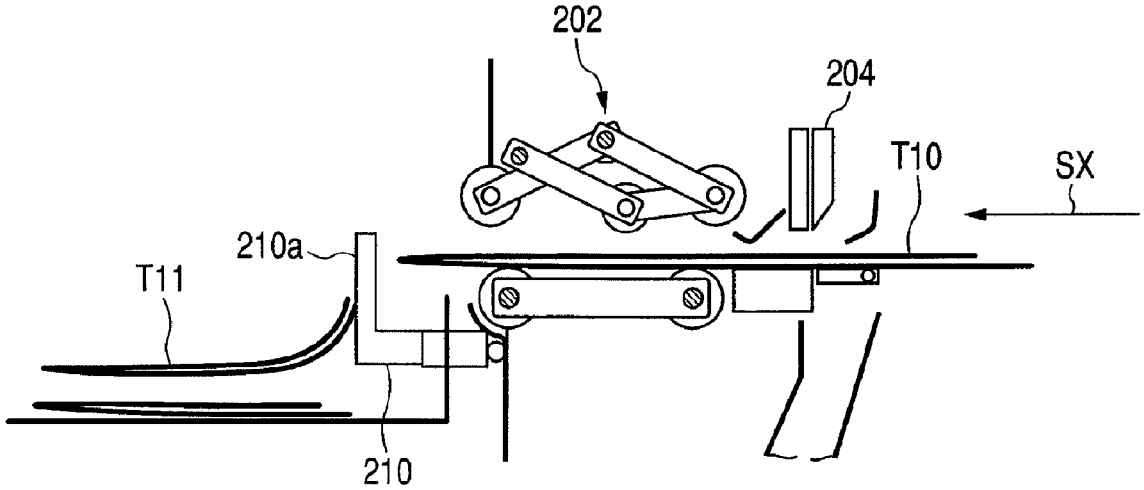
FIGS. 10A and 10B are explanatory partial enlarged side views illustrating another embodiment in which a registration member is disposed outside the apparatus.
Figure 10B:
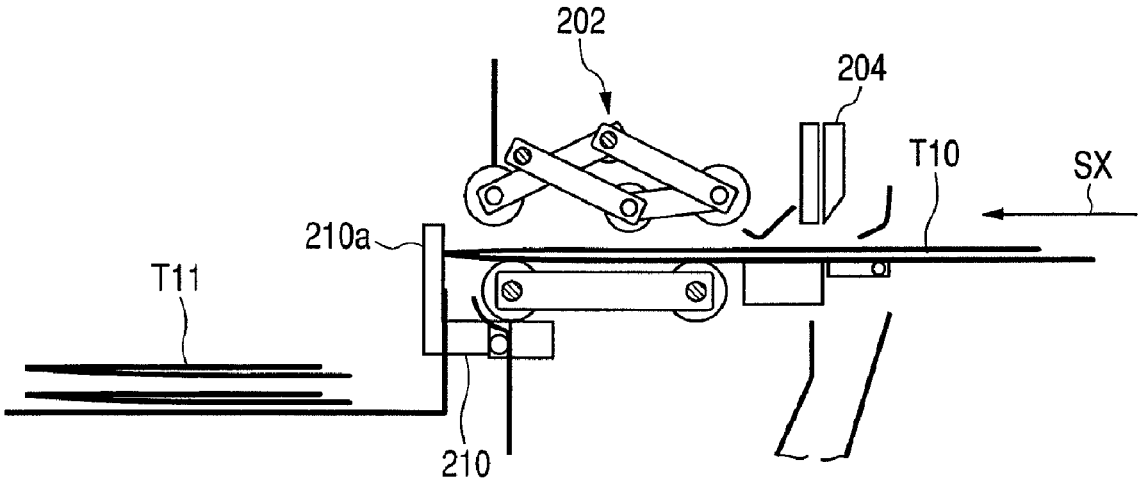

When the standby position of the registration unit 210 as the registration member is set to be at a position outside the apparatus in this way, it is desirable that the positional relationship be so that, as illustrated in FIG. 10A, a trailing edge portion (the right end portion as shown in FIG. 10A) of a half-folded sheet bunch T11 which is sent from the trimmer unit (sheet cutting apparatus) 90 is in contact with a rear surface side (the left end surface as shown in FIG. 10A) of the standing wall portion 210*a* of the above-mentioned registration unit 210. This is for the purpose of preventing, when, in particular, the large-size half-folded sheet bunch T11 is sent from the trimmer unit 90, the trailing edge portion of the half-folded sheet bunch T11 from being incompletely discharged to the outside of the apparatus resulting in unsatisfactory sheet stacking state. More specifically, as illustrated in FIG. 10A, because the trailing edge portion of the half-folded sheet bunch T11 is brought into contact with the rear surface side of the standing wall portion 210*a* of the registration unit 210, the half-folded sheet bunch T11 is moved by being pushed by the standing wall portion 210*a* of the registration unit 210, which is moved in the conveyance path, and a satisfactory sheet stacking state as illustrated in FIG. 10B is obtained.

Further, in this embodiment, when the above-mentioned skew feed correction is made, the folding roller pair 46*a* and 46*b* are adapted to rotate in the reverse direction as illustrated by arrows in FIG. 9B. The reverse rotation of the folding roller pair 46*a* and 46*b* is for the purpose of separating from the folding roller pair 46*a* and 46*b* without fail the edge portions of the half-folded sheet bunch T7 sent from the folding roller pair 46*a* and 46*b* without being caught. As a result, when the skew feed correction operation is made, the half-folded sheet bunch T7 can be pressed in to the proximity of the nip between the folding roller pair 46*a* and 46*b*. This means that L5 illustrated in FIG. 9B which is a length by which the half-folded sheet bunch T7 is pressed in toward the folding roller pair 46*a* and 46*b* is extended, and thus, the length of the apparatus can be made smaller for that accordingly.

[Description of the Control Configuration]

Next, a control configuration of the image forming system illustrated in FIG. 1 will be described with reference to a block diagram of FIG. 11. The above-mentioned image forming system includes an image forming apparatus control portion (hereinafter, referred to as "main body control portion") 150 of the copier (image forming apparatus) A and a control portion (hereinafter, referred to as "post-processing control portion") 160 of the sheet post-processing apparatus B. The main body control portion 150 includes an image formation control portion 151, a sheet feed control portion 152, and an input portion 153. Then, the setting of "image formation mode" or "post-processing mode" is made from a control panel 18 provided in the input portion 153. As described above, the "image formation mode" is to set image formation conditions, such as the number of print out sets, sheet size, enlargement/reduction printing, one-side/two-side printing, and others. Then, the main body control portion 150 controls the image formation control portion 151 and the sheet feed control portion 152 corresponding to the set image formation conditions, forms an image on a predetermined sheet, and then, sequentially discharges the sheet-shaped recording medium from the main-body sheet discharge outlet 3.

Concurrently therewith, the above-mentioned "post-processing mode" is set by input from the control panel 18. For example, "post-processing modes" are set, such as "print-out mode", "staple stitching finish mode", "sheet-bunch folding finish mode", or the like. Accordingly, the main body control portion 150 transfers, to the post-processing control portion 160, information on the finish mode, the number of sheets, and the number of sets in the post-processing, and information on a stitching mode (one-portion stitching, two-portion stitching, or multiple-portion stitching). Simultaneously therewith, the main body control portion 150 transfers a job finish signal to the post-processing control portion 160 whenever the image formation is completed.

The post-processing control portion 160 includes the control CPU 161 for operating the sheet post-processing apparatus B corresponding to the designated finish mode, a ROM 162 configured to store an operation program, and a RAM 163 configured to store control data. Then, the control CPU 161 includes a sheet conveyance control portion 164*a* configured to execute conveyance of a sheet sent to the inlet port 23*a*, a sheet stacking operation control portion 164*b* configured to execute the operation of stacking sheets, a stitching operation control portion 164*c* configured to execute sheet stitching processing, a sheet bunch folding operation control portion 164*d* configured to execute the sheet-bunch folding operation, a registration operation control portion 164*e* configured to control the registration solenoid 220 and the registration motor 221 to correct the skew feed of the sheet bunch, and a cutting operation control portion 164*f* configured to control the cutting member 204 to execute the sheet bunch cutting operation. With such structure of the control portion, "print-out mode", "staple stitching finish mode", "sheet-bunch folding finish mode", or the like can be processed by the sheet post-processing apparatus B.

According to this embodiment structured in this way, even in the case that the distance between the registration unit 210 as the registration member and the cutting blade 204 as the cutting member is small, the half-folded sheet bunch is conveyed after the skew feed correction is performed by the registration unit 210 so that the leading edge of the half-folded sheet bunch can be protruded outside the apparatus, and the cutting can be performed with the leading edge protruding outside the apparatus. Therefore, the distance between the registration unit 210 and the cutting blade 204 can be set to be shorter than the size of the half-folded sheet bunch, and the length of the apparatus as a whole in the conveying direction of the half-folded sheet bunch is drastically decreased accordingly.

Further, according to this embodiment, because the registration unit 210 as the registration member is adapted to make the skew feed correction when the registration unit 210 moves from the standby position, even when the distance between the registration unit 210 and the cutting blade 204 is drastically decreased, by moving the registration unit 210 according to the size of the half-folded sheet bunch, skew feed correction and cutting can be performed with respect to a large-size half-folded sheet bunch.

Further, according to this embodiment, because the standby position of the registration unit 210 as the registration member is set to be a position outside the apparatus, even if the length of the apparatus as a whole is drastically decreased, when the half-folded sheet bunch is large-size and long, the registration unit 210 can be positioned outside the apparatus accordingly, and, even in such a case, the skew feed correction function of the registration unit 210 is not impaired. Also, when the half-folded sheet bunch is small-size, the registration unit 210 can be positioned inside the apparatus. Therefore, there is no need to convey the half-folded sheet bunch of the small-size to the outside of the apparatus, and thus the time required for the skew-feed correction can be shortened.

Still further, according to this embodiment, a structure in which the registration unit 210 is moved to a position for a larger size or a position for a smaller size according to the size of the sheet bunch is described above. However, registration units may be provided at the position for a larger size and the position for a smaller size, respectively, so that the registration units are selectively used according to the size of the sheet bunch instead of one registration unit moving between the position for a larger size and the position for a smaller size.

Further, in the above, a structure in which the registration unit 210 moves between the position for a larger size and the position for a smaller size according to the size of the sheet bunch and a structure in which a registration unit is provided at each size position are described. However, a registration unit may be provided at a position outside the sheet discharging roller pair 203*a* and 203*b* as the discharging means and outside the apparatus so as to be freely extendable from within the apparatus for conveying all sheet bunches irrespectively of the size thereof to the registration unit positioned outside to correct the registration.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

For example, in the above-mentioned embodiment, the present invention is applied to an image forming system including a copier. However, the present invention may also be applied to an image forming system including other image forming apparatuses, such as a printer, an image forming apparatus alone, or a sheet cutting apparatus alone.

For example, the registration member according to the present invention may be used in a sheet aligning apparatus configured to align sheets conveyed to a conveyance path. When sheets are conveyed to the conveyance path, the registration member moves from the retracting position below the conveyance path to the standby position on the conveyance path. When the registration member moves upstream in the conveying direction of the sheets from the standby position, the registration member comes into contact with leading edge portions of the sheets to correct a skew feed of the sheets and align the sheets. The aligned sheets are discharged to the stack tray by a discharging member. The standby position of the registration member may be positioned outside the discharging member.

A sheet processing apparatus may comprises a sheet aligning apparatus, and a cutting member configured to cut a trailing edge portion of a half-folded sheet bunch in a sheet-bunch conveying direction, the cutting member being positioned upstream of a registration member in the sheet-bunch conveying direction, wherein a leading edge portion of the half-folded sheet bunch is positioned outside a discharging member when, after a skew feed of the half-folded sheet bunch is corrected by the registration member, the half-folded sheet bunch is conveyed downstream in the sheet-bunch conveying direction by a conveying member and the trailing edge portion of the half-folded sheet bunch is conveyed to a cutting position of the cutting member to cut the trailing edge portion.

As described above, a sheet cutting apparatus and a sheet post-processing apparatus and an image forming system which include the sheet cutting apparatus according to the present invention may be applied to various kinds of image forming apparatuses, such as a printer and a copier and other apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-092730, filed Apr. 7, 2009, and No. 2010-086730, filed Apr. 5, 2010 which are hereby incorporated by reference herein in their entirety.

What is claimed is:

1. A sheet cutting apparatus, comprising:

a conveying member configured to convey a half-folded sheet bunch into which sheets are half-folded, the conveying member being provided in a conveyance path through which the half-folded sheet bunch is conveyed;

a registration member which comes into contact with a leading edge portion of the conveyed half-folded sheet bunch to correct a skew feed of the half-folded sheet bunch;

a cutting member configured to cut a trailing edge portion of the half-folded sheet bunch in a sheet-bunch conveying direction of the half-folded sheet bunch; and a controller configured to control the conveying member, the registration member, and the cutting member in such a manner that after the skew feed is corrected by the registration member, the registration member is retracted from the conveyance path, and thereafter the leading edge portion of the half-folded sheet bunch is conveyed downstream of a position in which the registration member comes into contact with the leading edge portion in the sheet-bunch conveying direction by the conveying member, to convey the trailing edge portion of the half-folded sheet bunch to a cutting position of the cutting member so that the trailing edge portion is cut with the cutting member.

2. A sheet cutting apparatus according to claim 1, wherein, when the half-folded sheet bunch is conveyed to the conveyance path, the registration member moves from a retracting position below the conveyance path to a standby position on the conveyance path and, when the registration member moves upstream in the sheet-bunch conveying direction from the standby position, the registration member comes into contact with the leading edge portion of the half-folded sheet bunch to correct the skew feed of the half-folded sheet bunch and, after the skew feed of the half-folded sheet bunch is corrected, the registration member returns from the conveyance path to the retracting position.

3. A sheet cutting apparatus according to claim 2, wherein a distance between the standby position of the registration member and a cutting position of the cutting member is shorter than a size of the half-folded sheet bunch from the leading edge portion to the trailing edge portion before the half-folded sheet bunch conveyed to the sheet cutting apparatus is cut with the cutting member.

4. A sheet cutting apparatus according to claim 2, further comprising a discharging member configured to discharge the half-folded sheet bunch, the discharging member being provided at an outlet of the conveyance path, wherein the standby position of the registration member is set to be downstream of the discharging member in the sheet-bunch conveying direction.

5. A sheet cutting apparatus according to claim 2, further comprising a discharging member configured to discharge the half-folded sheet bunch, the discharging member being provided at an outlet of the conveyance path, wherein the standby position of the registration member is set to be upstream of the discharging member in the sheet-bunch conveying direction when a size of the half-folded sheet bunch is smaller than a predetermined size, and the standby position of the registration member is set to be downstream of the discharging member in the sheet-bunch conveying direction when the size of the half-folded sheet bunch is the predetermined size or larger.

6. A sheet processing apparatus, comprising:

a saddle stitching unit configured to perform saddle stitching of a half-folded sheet bunch into sheets that are folded about a half-folded portion of the sheets in a shape of a brochure; and cutting apparatus as recited in claim 1 which is coupled with the saddle stitching unit.

7. An image forming apparatus, comprising:

an image forming portion configured to form an image; and a sheet processing apparatus as recited in claim 6 which is coupled with the image forming portion.

8. An image forming system, comprising:

an image forming apparatus configured to form an image; and a sheet processing apparatus as recited in claim 6 which is coupled with the image forming apparatus.

9. A sheet cutting apparatus, comprising:

a conveying member configured to convey a sheet in a conveyance path;

a registration member which comes into contact with a leading edge portion of the conveyed sheet to correct a skew feed of the sheet;

a cutting member configured to cut a trailing edge portion of the sheet in a sheet conveying direction of the sheet; and a controller configured to control the conveying member, the registration member, and the cutting member in such a manner that after the skew feed is corrected by the registration member, the registration member is retracted from the conveyance path, and thereafter the leading edge portion of the sheet is conveyed downstream of a position in which the registration member comes into contact with the leading edge portion in the sheet conveying direction by the conveying member, to convey the trailing edge portion of the sheet to a cutting position of the cutting member so that the trailing edge portion is cut with the cutting member.

10. A sheet processing apparatus, comprising:

a stitching unit configured to stitch sheets into a sheet bunch; and a sheet cutting apparatus as recited in claim 9 which is coupled with the stitching unit.

11. An image forming apparatus, comprising:

an image forming portion configured to form an image; and a sheet processing apparatus as recited in claim 10 which is coupled with the image forming portion.

* * * * *